US007985145B1

(12) United States Patent
Chu

(10) Patent No.: US 7,985,145 B1
(45) Date of Patent: Jul. 26, 2011

(54) PORTABLE SPORTS SWING FEEDBACK APPARATUS

(76) Inventor: James Chu, Mountain View, CA (US)

( * ) Notice: Subject to any disclaimer, the term of this patent is extended or adjusted under 35 U.S.C. 154(b) by 0 days.

(21) Appl. No.: 12/554,007

(22) Filed: Sep. 4, 2009

Related U.S. Application Data

(60) Provisional application No. 61/094,058, filed on Sep. 4, 2008.

(51) Int. Cl.
*A63B 69/36* (2006.01)

(52) U.S. Cl. ..... 473/257; 473/409

(58) Field of Classification Search ..... 473/219, 473/240, 257, 266, 267, 268, 409
See application file for complete search history.

(56) References Cited

U.S. PATENT DOCUMENTS 3,917,278 A * 11/1975 Steinman, Jr. ..... 473/267
4,053,160 A * 10/1977 Salata ..... 473/240
5,071,129 A * 12/1991 Wilson ..... 473/240
5,116,058 A 5/1992 Theriault
5,486,003 A 1/1996 Loew et al.
5,634,858 A * 6/1997 Bellagamba ..... 473/257
6,799,335 B1 * 10/2004 Zadro ..... 4/605
2009/0135509 A1 * 5/2009 Englander ..... 359/841

* cited by examiner

*Primary Examiner* — Nini Legesse
(74) *Attorney, Agent, or Firm* — Ashok Tankha; Lipton, Weinberger & Husick

(57) ABSTRACT

A portable apparatus and method for providing real time visual feedback of a sports swing to a user is provided. The portable apparatus comprises a rotatable reflecting surface housed in a frame, an attachment assembly connected to a rear section of the frame, a telescopic pole rotatably attached to the attachment assembly, and a fastener. The rotatable reflecting surface enables the user to view the sports swing. The attachment assembly facilitates rotation of the rotatable reflecting surface housed in the frame about a first axis. The telescopic pole facilitates rotation of the rotatable reflecting surface about a second axis. In an embodiment, the telescopic pole is rigidly attached to a pole holder that accommodates the telescopic pole. The fastener is pivotally attached to the telescopic pole for facilitating rotation of the telescopic pole about a third axis. The fastener enables attachment of the portable apparatus to different sports equipment.

20 Claims, 17 Drawing Sheets

PORTABLE SPORTS SWING FEEDBACK APPARATUS

CROSS REFERENCE TO RELATED APPLICATIONS

This application claims the benefit of provisional patent application No. U.S. 61/094,058 titled "Portable Golf Swing Feedback Apparatus", filed on Sep. 4, 2008 in the United States Patent and Trademark Office.

BACKGROUND

While playing golf, a golfer requires proper body movement for a proper golf swing. Even a slight improper body movement can negatively affect a golfer's golf swing; thus impacting the golfer's performance. Often, golfers do not realize or cannot visualize the problems in their golf swings until they actually see their own swings. Therefore, golfers require visual feedback to improve their golf swings. Visual feedback provides an aid to identify what golfers need to do to improve their golf swings. Similarly, there is a need for visual feedback in other sports to provide an aid to identify what sports persons need to do to improve their sport swings.

A golf training aid, for example, a camcorder provides golfers with visual feedback on their golf swings. However, a camcorder does not provide real time visual feedback to golfers. The associated time delay of the visual feedback precludes golfers from correlating the physical movements of their golf swings and provides a time-delayed view of the golf swing. As a result, golfers usually end up performing multiple recording sessions. Through a process of trial and error with these multiple recording sessions, golfers might be able to improve their swings. Also, owing to the camcorder's non-real time nature, using a camcorder as a golf training aid for providing visual feedback tends to be tedious and time inefficient.

Other training aids, for example, mirrors also provide golfers with real time visual feedback on the golf swing. However, mirrors either have a large rectangular shape or are of a large circular convex geometry, which are therefore generally bulky and exist as separate pieces of equipment that make them very inconvenient to carry around. Golfers, therefore, need to carry an additional large and bulky golf mirror in addition to the golf equipment in their golf bags. Due to this inconvenience, these mirrors are rarely used by golfers.

Hence, there is a need for a compact and portable sports training apparatus that provides real time visual feedback of a sports swing to a user. Moreover, there is a need for a compact training apparatus that can be integrated with existing sports equipment and is therefore convenient to use and carry around while playing.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The portable apparatus and method disclosed herein addresses the above stated need for providing real time visual feedback of a sports swing, for example, a golf swing, to a user. The portable apparatus disclosed herein may be attached to different sports equipment, for example, golf equipment such as golf bags, golf carts, and station dividers in driving ranges, in practicing environments.

The portable apparatus comprises a rotatable reflecting surface, an attachment assembly, a telescopic pole, and a fastener. The rotatable reflecting surface of a predefined shape, for example, a circular shape, a rectangular shape, etc. is housed in a frame. The frame accommodates the rotatable reflecting surface. The frame defines a periphery and a rear section. The rotatable reflecting surface is, for example, a convex minor of a circular shape and housed in a circular frame. The rotatable reflecting surface enables the user to view the sports swing.

The attachment assembly is connected to the rear section of the frame for facilitating rotation of the rotatable reflecting surface housed in the frame about a first axis. In an embodiment, the attachment assembly comprises a fixed bracket and a rotating bracket. The fixed bracket is rigidly attached to the rear section of the frame. The rotating bracket is pivotally attached to the fixed bracket for facilitating rotation of the rotatable reflecting surface about the first axis. In another embodiment, the attachment assembly comprises a ball joint that connects the rear section of the frame accommodating the rotatable reflecting surface to the telescopic pole. The ball joint enables rotation of the rotatable reflecting surface about the ball joint.

The telescopic pole of the portable apparatus is rotatably attached to the attachment assembly for facilitating rotation of the rotatable reflecting surface housed in the frame about a second axis. The telescopic pole comprises a predetermined number of coaxial concentric sections for allowing extension and retraction of the telescopic pole in accordance with the height of the user. In an embodiment, the portable apparatus further comprises a pole holder defining a hollow tubular body to accommodate the telescopic pole along the second axis. The telescopic pole is rigidly attached to the pole holder. In an embodiment, the pole holder comprises a cavity for fitting the rotating bracket of the attachment assembly when the telescopic pole is completely retracted into the pole holder.

The fastener is pivotally attached to the telescopic pole for facilitating rotation of the telescopic pole about a third axis. The fastener enables attachment of the portable apparatus to different sports equipment. The fastener enables pivoting of the pole holder to a desired pivot angle about the third axis for facilitating final positioning of the rotatable reflecting surface housed in the frame. The final positioning of the rotatable reflecting surface allows the user to obtain a desired view of the sports swing of the user. The rotatable reflecting surface is also positioned at a distance from the user for providing a desired field of view to the user.

The portable apparatus further comprises a rotatable line element representing a swing plane line disposed over the rotatable reflecting surface housed in the frame. The rotatable line element enables the user to sweep the rotatable line element over the rotatable reflecting surface housed in the frame to provide guidance to the user for simulating a swing plane. The swing plane may vary with the height of the user. In an embodiment, the rotatable line element is hinged to the center of the rotatable reflecting surface housed in the frame. The rotatable line element conforms to the contour of the rotatable reflecting surface housed in the frame. The rotatable line element enables the user to rotate the rotatable line element over the rotatable reflecting surface through the hinged center to provide guidance to the user to simulate a proper swing plane.

In another embodiment, the opposing ends of the rotatable line element are slidably attached to a hollow track disposed along the periphery of the frame housing the rotatable reflecting surface. The rotatable line element enables the user to rotate the rotatable line element over the rotatable reflecting surface along the hollow track to provide guidance to the user to simulate a proper swing plane.

The portable apparatus may further comprise an image recording device positioned between the rotatable reflecting surface and the frame housing the rotatable reflecting surface for recording a moving image of the sports swing of the user obtained on the rotatable reflecting surface.

The portable apparatus may also be directly attached to the sports equipment without the fastener. The portable apparatus may be made a part of the sports equipment, thereby enabling integration of the portable apparatus to the sports equipment, and eliminating the need for the user to carry an additional piece of equipment. The attachment of the rotatable reflecting surface of the portable apparatus to the sports equipment through the fastener and positioning the attached rotatable reflecting surface for obtaining a desired field of view provides the real time visual feedback of the sports swing to the user.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and instrumentalities disclosed herein.

DETAILED DESCRIPTION OF THE INVENTION

Figure 1:
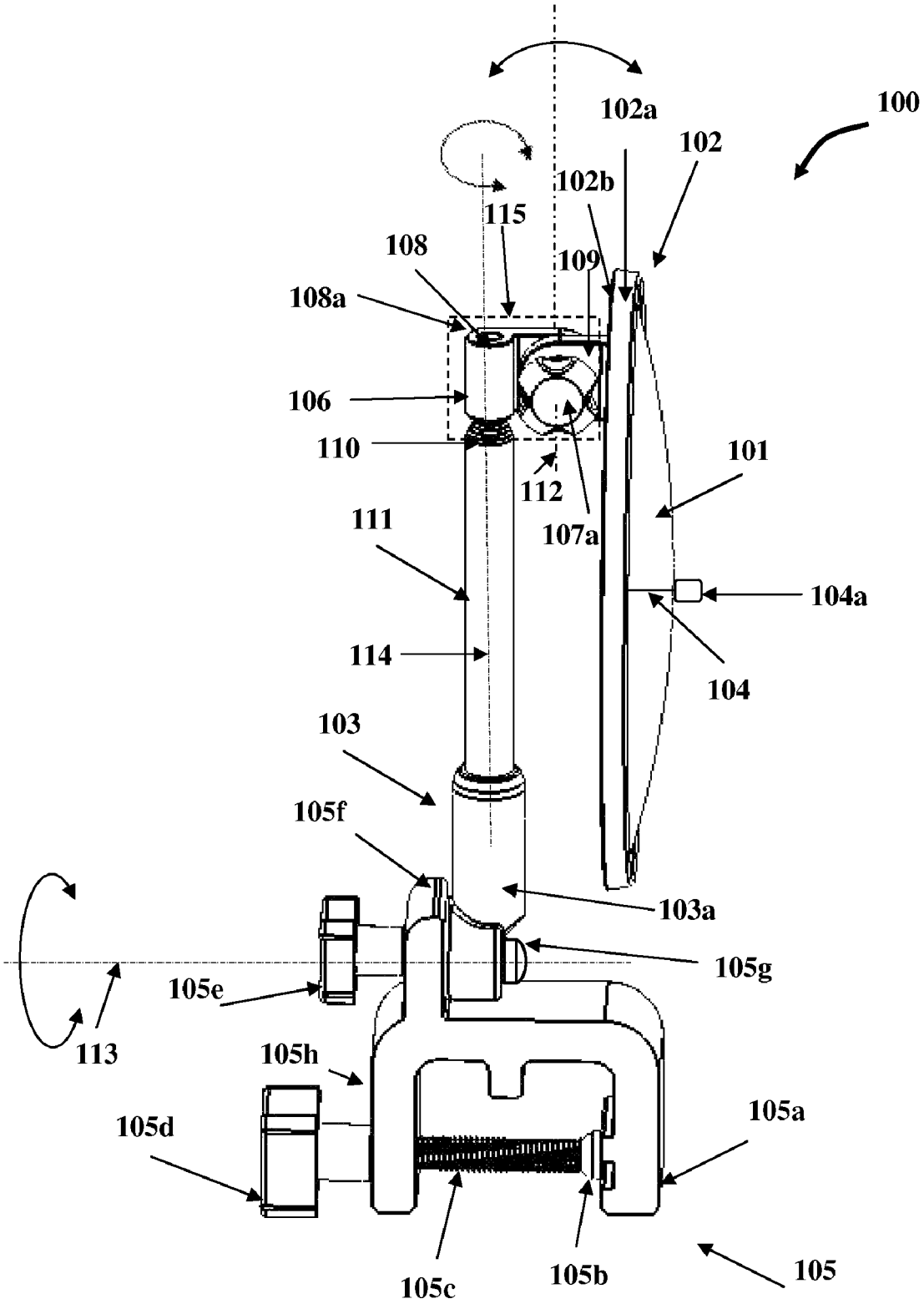
FIG. 1 exemplarily illustrates a left side perspective view of a portable apparatus that provides real time visual feedback of a sports swing to a user.

FIG. 1 exemplarily illustrates a left side perspective view of a portable apparatus 100 that provides real time visual feedback of a sports swing, for example, a golf swing, to a user. As used herein, the term "user" refers to a sports person or other person who uses the portable apparatus 100 to improve their sports swing, for example, a golf swing, a tennis swing, etc. while playing a sport, for example, golf, tennis, etc. The portable apparatus 100 disclosed herein comprises a rotatable reflecting surface 101, an attachment assembly 115, a telescopic pole 111, and a fastener 105. The rotatable reflecting surface 101 is, for example, a convex mirror of a predefined shape, for example, a circular shape, a rectangular shape, etc. The rotatable reflecting surface 101 enables the user to view the sports swing when the user is standing in front of the rotatable reflecting surface 101. The rotatable reflecting surface 101 is housed in a frame 102. The frame 102 accommodates the rotatable reflecting surface 101. The frame 102 defines a periphery 102*a* and a rear section 102*b*. The frame 102 is made of, for example, polycarbonate, nylon, etc.

The attachment assembly 115 is connected to the rear section 102*b* of the frame 102 for facilitating rotation of the rotatable reflecting surface 101 housed in the frame 102 about a first axis 112. The rotatable reflecting surface 101 is rotatable along a vertical plane about the generally horizontal first axis 112 as exemplarily illustrated in FIG. 1. In an embodiment as exemplarily illustrated in FIGS. 1-4 and FIGS. 6-8, the attachment assembly 115 comprises a fixed bracket 109 and a rotating bracket 106. The fixed bracket 109 is rigidly attached to the rear section 102*b* of the frame 102. The rotating bracket 106 is pivotally attached to the fixed bracket 109 for facilitating rotation of the rotatable reflecting surface 101 about the first axis 112. In another embodiment, the attachment assembly 115 comprises a ball joint 109*b* as disclosed in the detailed description of FIG. 9.

The telescopic pole 111 of the portable apparatus 100 is rotatably attached to the attachment assembly 115 for facilitating rotation of the rotatable reflecting surface 101 housed in the frame 102 about a second axis 114. The rotatable reflecting surface 101 is rotatable along a horizontal plane about the generally vertical second axis 114 as exemplarily illustrated in FIG. 1. The telescopic pole 111 comprises a predetermined number of coaxial concentric sections 110 for allowing extension and retraction of the telescopic pole 111 in accordance with the height of the user. In an embodiment, the portable apparatus 100 further comprises a pole holder 103 defining a hollow tubular body 103*a* to accommodate the telescopic pole 111 along the second axis 114. The telescopic pole 111 is rigidly attached to the pole holder 103.

As exemplarily illustrated in FIG. 1, the telescopic pole 111 is rotatably attached to the rotating bracket 106 of the attachment assembly 115 for facilitating rotation of the rotatable reflecting surface 101 about the second axis 114. The pole holder 103 is pivotally attached to a fastener 105 for facilitating rotation of the pole holder 103 about a third axis 113 as exemplarily illustrated in FIG. 1.

The fastener 105 is pivotally attached to the telescopic pole 111 for facilitating rotation of the telescopic pole 111 about the third axis 113. The telescopic pole 111 is rotatable along a vertical plane about the generally horizontal third axis 113 as exemplarily illustrated in FIG. 1. The fastener 105 enables attachment of the portable apparatus 100 to different sports equipment, for example, golf equipment such as golf bags 1301, golf carts 1402, etc. The fastener 105 enables pivoting of the pole holder 103 to a desired pivot angle about the third axis 113 for facilitating final positioning of the rotatable reflecting surface 101 housed in the frame 102. The final positioning of the rotatable reflecting surface 101 allows the user to obtain a desired view of a sports swing of the user. The rotatable reflecting surface 101 is also positioned at a distance from the user for providing a desired field of view to the user.

The fastener 105 is made of, for example, aluminum casting, fabricated steel, polycarbonate, nylon, etc. The fastener 105 is, for example, a clamp, a clip, a spring loaded caliper, etc. In an embodiment as exemplarily illustrated in FIG. 1, the fastener 105 is a lower case "h" shaped clamp. The fastener 105 enables integration of the portable apparatus 100 to the sports equipment. The rotatable reflecting surface 101 and/or the pole holder 103 can move in different planes about the three axes 112, 113, and 114 depending upon the orientation of the portable apparatus 100 with respect to the ground.

Figure 3A:
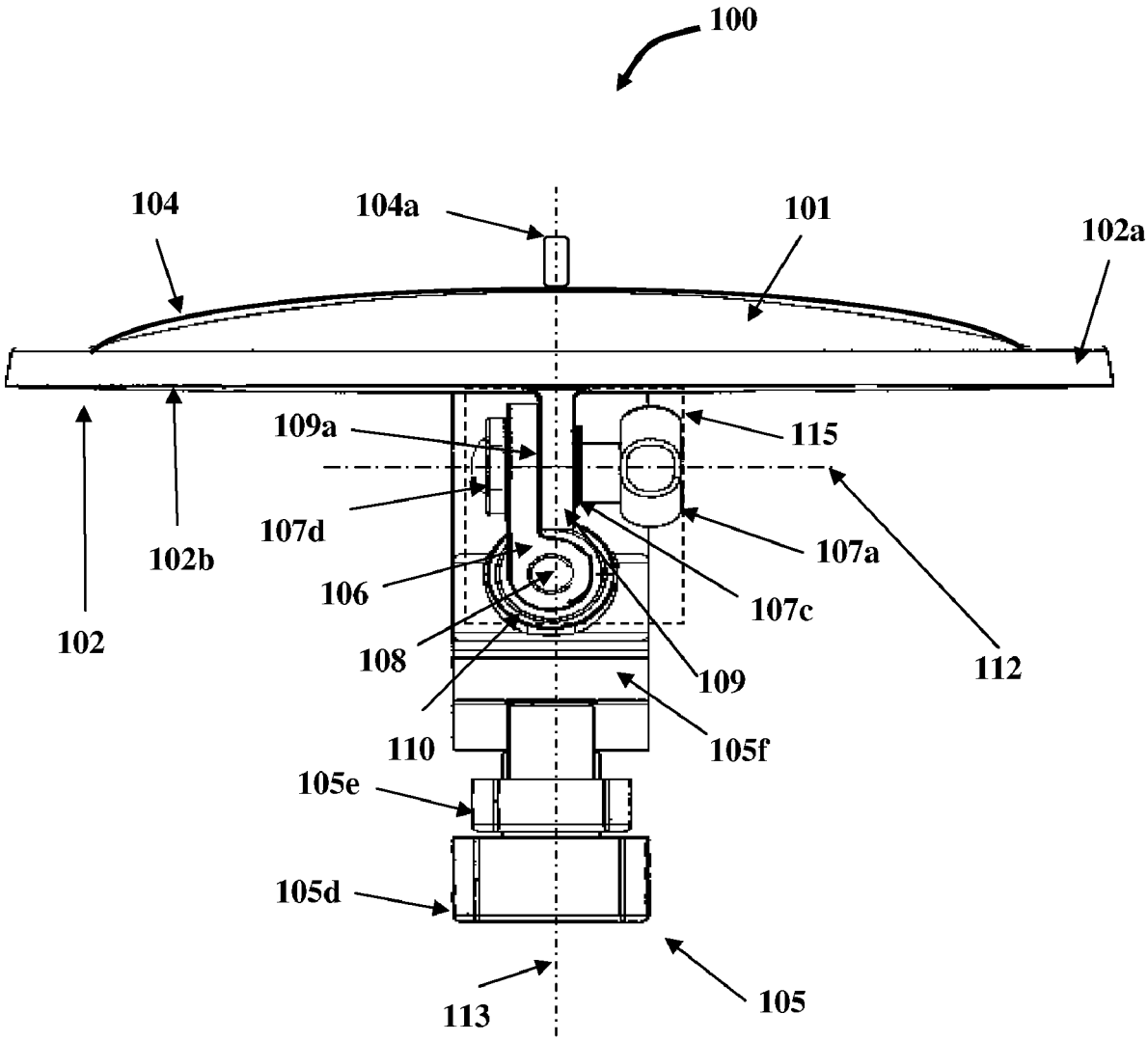
FIG. 3A exemplarily illustrates an orthogonal top view of the portable apparatus, showing an embodiment of a rotatable line element of the portable apparatus.
Figure 3B:
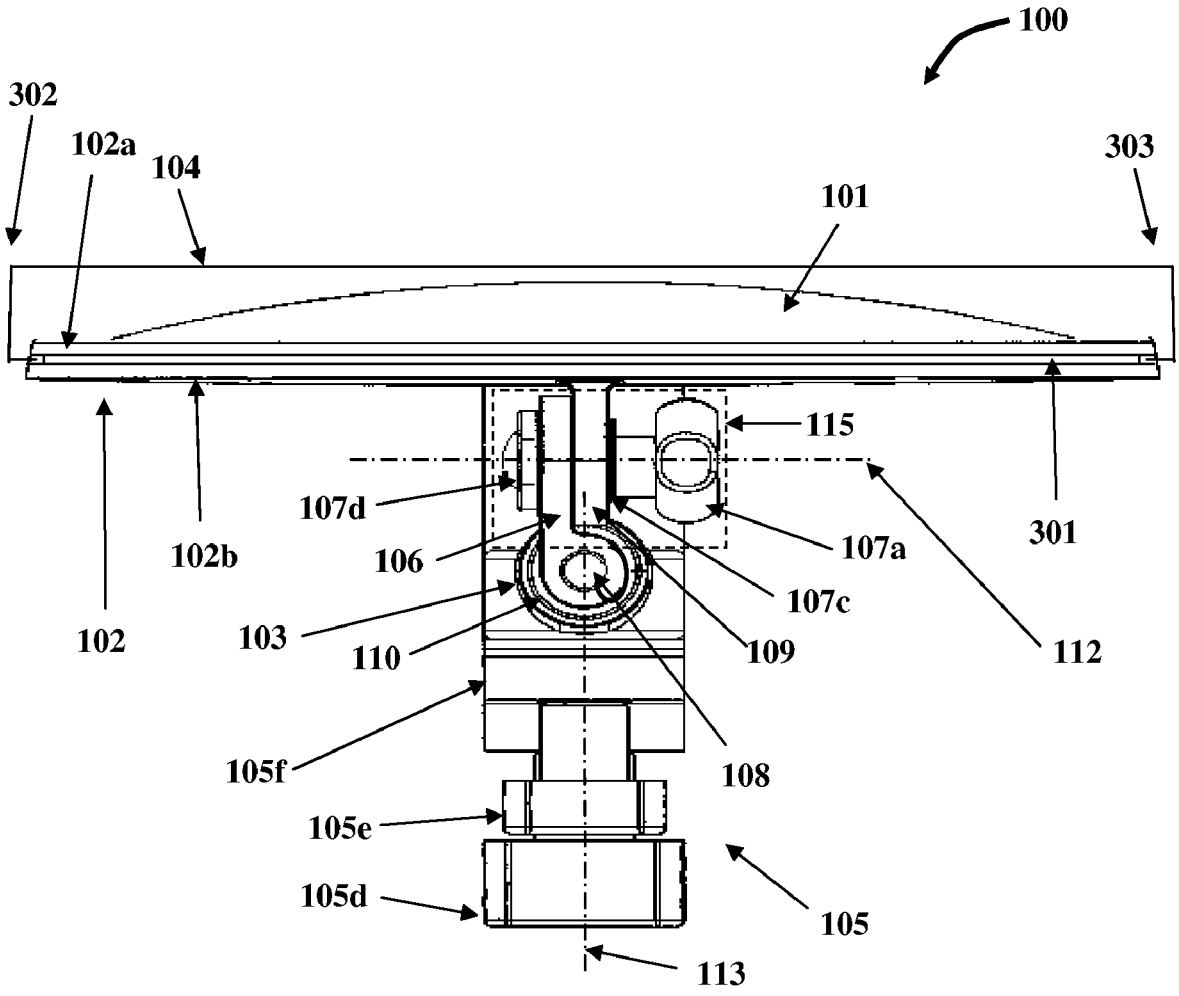
FIG. 3B exemplarily illustrates an orthogonal top view of the portable apparatus, showing another embodiment of the rotatable line element.

The portable apparatus 100 further comprises a rotatable line element 104 representing a swing plane line disposed over the rotatable reflecting surface 101 housed in the frame 102 as disclosed in the detailed description of FIGS. 3A-3B. The rotatable line element 104 is rotatably disposed over the rotatable reflecting surface 101. The rotatable line element 104 enables the user to sweep the rotatable line element 104 over the rotatable reflecting surface 101 housed in the frame 102 to provide guidance to the user for simulating a swing plane. The swing plane may vary with the height of the user. As used herein, a swing plane is a plane formed by the movement of a piece of sports equipment, for example, a golf club, along a generally circular arc as the golf club head is moved by the user for striking the golf ball and for following through with the sports swing.

The portable apparatus 100 allows the user to practice sports swings in front of or adjacent to the rotatable reflecting surface 101 with the user facing the rotatable reflecting surface 101. The rotatable reflecting surface 101 may be positioned in a generally vertical position at a distance from the user for providing a desired field of view to the user. The user may also stand near the portable apparatus 100 for viewing the sports swing in the rotatable reflecting surface 101. The user can obtain, for example, a full length view, a half body view, full body view, etc. by standing closer or farther from the rotatable reflecting surface 101.

The rotatable reflecting surface 101 allows the user to accurately understand and correlate the physical movements of the user with the resulting appearance or trajectory of the sports swing on the rotatable reflecting surface 101. The rotatable reflecting surface 101 is made part of the sports equipment for obtaining real time visual feedback of the sports swing.

Figure 2:
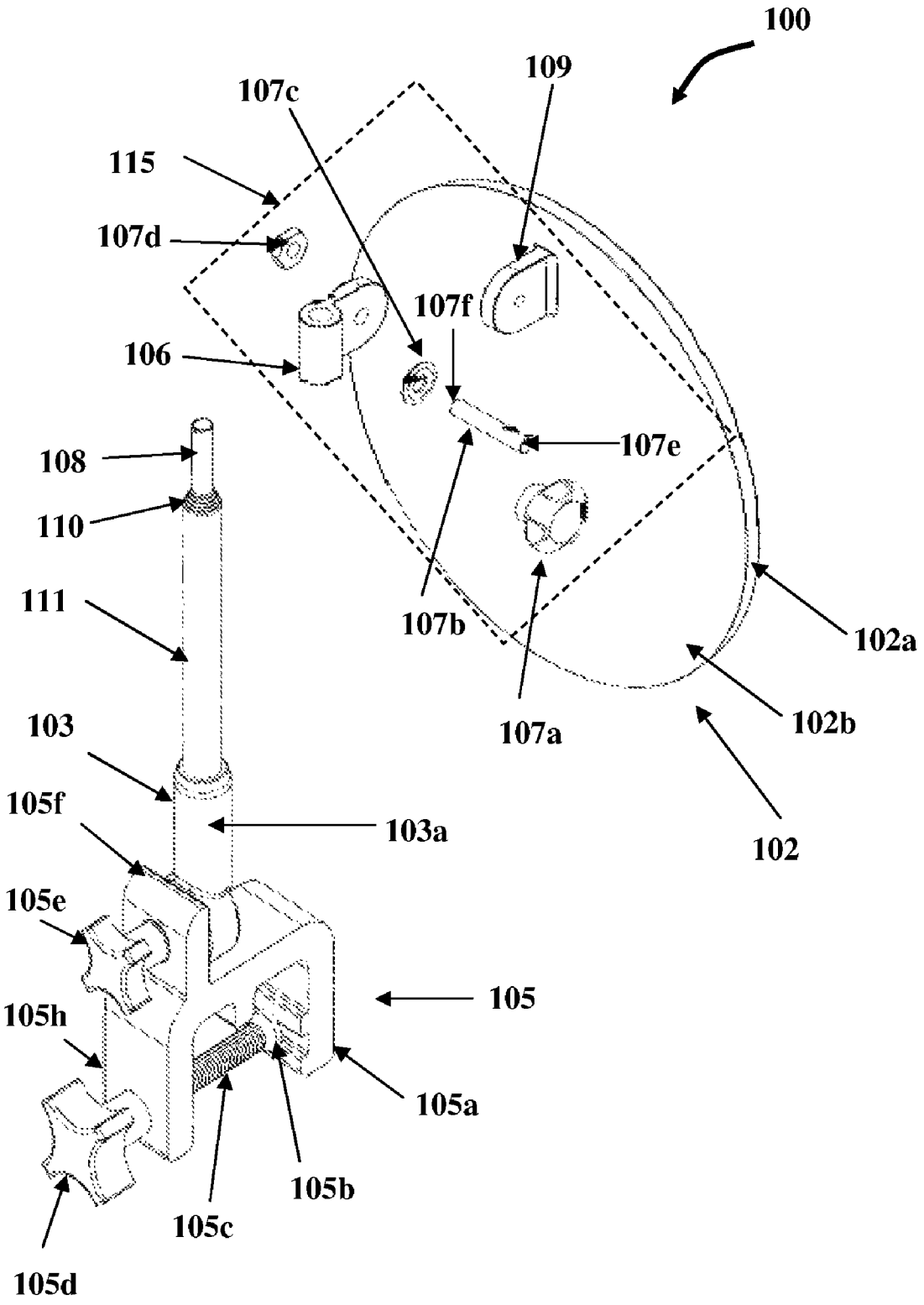
FIG. 2 exemplarily illustrates a partly exploded perspective view of the portable apparatus.

FIG. 2 exemplarily illustrates a partly exploded perspective view of the portable apparatus 100. The attachment assembly 115 exemplarily illustrated in FIG. 2 comprises the fixed bracket 109, the rotating bracket 106, a handle 107*a*, a threaded stud 107*b*, a washer 107*c*, and a nut 107*d*. The fixed bracket 109 of the attachment assembly 115 is rigidly attached to the rear section 102*b* of the frame 102. The rotating bracket 106 is pivotally attached to the fixed bracket 109 using the threaded stud 107*b*, the nut 107*d*, and the washer 107*c*. The nut 107*d* is made of, for example, steel. The washer 107*c* is, for example, a Bellville washer. The handle 107*a* of the attachment assembly 115 is rigidly attached to a first end 107*e* of the threaded stud 107*b*. The nut 107*d* engages the second end 107*f* of the threaded stud 107*b*. By turning the nut 107*d*, the threaded stud 107*b* can be rotated, allowing the rotatable reflecting surface 101 housed in the frame 102 to be locked in any desired position about the first axis 112, around the threaded stud 107*b*. A user can, for example, loosen the fixed bracket 109 by turning the handle 107*a*. When the frame 102 housing the rotatable reflecting surface 101 is set to a desired position, the user can tighten the fixed bracket 109 by turning the handle 107*a* again to lock the rotatable reflecting surface 101 in that position. The rotating bracket 106 has a predefined shape, for example, a "U" shape. The rotating bracket 106 and the fixed bracket 109 are made of, for example, polycarbonate, nylon, etc. The fixed bracket 109 may be made integral to the rear section 102*b* of the frame 102. The pivotal joint 109*a*, exemplarily illustrated in FIG. 4, between the fixed bracket 109 and the rotating bracket 106 enables limited swiveling of the rotatable reflecting surface 101 housed in the frame 102 about the first axis 112.

In another embodiment, the nut 107*d* forms an integral part of the rotating bracket 106, eliminating the need for a separate nut 107*d*. In another embodiment, the rotating bracket 106 comprises internal threads that engages the threaded stud 107*b*, thereby eliminating the need for a separate nut 107*d*.

FIG. 3A exemplarily illustrates an orthogonal top view of the portable apparatus 100 showing an embodiment of the rotatable line element 104 of the portable apparatus 100. In this embodiment, the rotatable line element 104 is hinged to the center of the rotatable reflecting surface 101 housed in the frame 102. The rotatable line element 104 conforms to the contour of the rotatable reflecting surface 101 housed in the frame 102. The rotatable line element 104 enables the user to rotate the rotatable line element 104 over the rotatable reflecting surface 101 through the hinged center to provide guidance to the user to simulate a proper swing plane when the user tries to follow the swing plane. The rotatable line element 104 is rotatable, for example, by turning a knob 104*a* positioned at the hinged center, using fingers to sweep the rotatable line element 104 over the rotatable reflecting surface 101. The rotatable line element 104 and the knob 104*a* are made of, for example, plastic.

FIG. 3B exemplarily illustrates an orthogonal top view of the portable apparatus 100, showing another embodiment of the rotatable line element 104. In this embodiment, the opposing ends 302 and 303 of the rotatable line element 104 are slidably attached to a hollow track 301 disposed along the periphery 102*a* of the frame 102 housing the rotatable reflecting surface 101. The rotatable line element 104 enables the user to rotate the rotatable line element 104 over the rotatable reflecting surface 101 along the hollow track 301 to provide guidance to the user to simulate a proper swing plane when the user tries to follow the swing plane. The opposing ends 302 and 303 of the rotatable line element 104 engage the hollow track 301 illustrated in FIG. 3B and facilitate rotation of the rotatable line element 104. For example, the user can rotate the rotatable line element 104 over the rotatable reflecting surface 101 with his/her hand such that the opposing ends 302 and 303 of the rotatable line element 104 slide along the hollow track 301.

Figure 4:
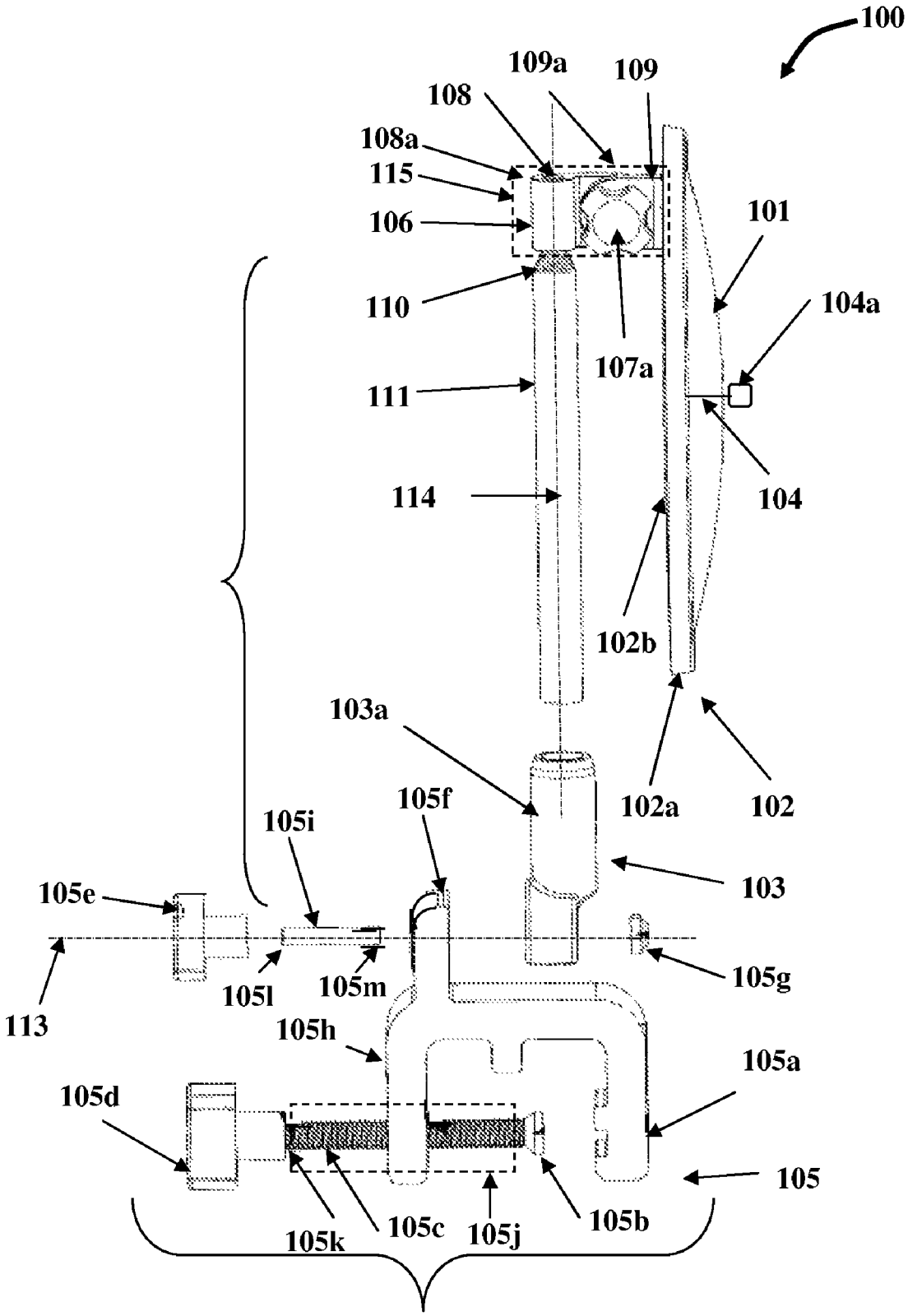
FIG. 4 exemplarily illustrates a partly exploded side perspective view of the portable apparatus.

FIG. 4 exemplarily illustrates a partly exploded side perspective view of the portable apparatus 100. The pole holder 103 defines a hollow tubular body 103*a* to accommodate the telescopic pole 111 that moves in a clockwise or counterclockwise direction about the third axis 113. The pole holder 103 is made of, for example, polycarbonate, nylon, etc. The telescopic pole 111 is rigidly attached to the hollow tubular body 103*a* of the pole holder 103. The telescopic pole 111 comprises a predetermined number of coaxial concentric sections 110 of a generally similar cross-section, for example, a circular cross-section. The coaxial concentric sections 110 lie along the second axis 114 and are axially extendable and retractable relative to each other due to their differing diameters. The lowermost coaxial concentric section of the telescopic pole 111 is rigidly attached to the pole holder 103 by, for example, riveting to the hollow tubular body 103*a* of the pole holder 103, and the upper end 108 of the uppermost coaxial concentric section of the telescopic pole 111 is rotatably attached to the rotating bracket 106. The joint 108*a* at the upper end 108 of the telescopic pole 111 allows complete rotation of the rotatable reflecting surface 101 about the second axis 114. The user can rotate the rotatable reflecting surface 101 housed in the frame 102 up to, for example, 360 degrees about the second axis 114. The tightness of the joint 108*a* and the friction between the different coaxial concentric sections 110 of the telescopic pole 111, allows the rotatable reflecting surface 101 housed in the frame 102 to remain fixed in a desired position about the second axis 114.

The telescopic pole 111 is used for adjusting the height of the rotatable reflecting surface 101. The telescopic pole 111 is made of, for example, stainless steel. The telescopic pole 111 can be extended to a desired length, thereby enabling users of different heights to use the portable apparatus 100. For example, for a short user, the telescopic pole 111 may be extended to a lesser height. The telescopic pole 111 may be fully retracted when not in use, as exemplarily illustrated in FIG. 5. The coaxial concentric sections 110 of the telescopic pole 111 are rotatable about the second axis 114 enabling the user to freely rotate the rotatable reflecting surface 101 housed in the frame 102 about the second axis 114.

The lowermost coaxial concentric section of the telescopic pole 111 may also be directly attached to any sports equipment by, for example, welding, soldering, riveting, etc. In an embodiment, the pole holder 103 comprises a cavity 801 of a predefined shape, for example, a "U" shape, for fitting the rotating bracket 106 of the attachment assembly 115 when the telescopic pole 111 is completely retracted into the pole holder 103. In this embodiment, the pole holder 103 extends till the top of the telescopic pole 111 as exemplarily illustrated in FIG. 8. When the telescopic pole 111 is completely retracted into the pole holder 103, the rotating bracket 106 fits into the "U" shaped cavity 801 at the top of the pole holder 103. When the rotating bracket 106 fits into the "U" shaped cavity 801 at the top of the pole holder 103, the "U" shaped cavity 801 prevents the rotating bracket 106 and/or the telescopic pole 111 from wobbling along the second axis 114.

The fastener 105 detachably attaches the portable apparatus 100 to different sports equipment, for example, a golf bag 1301, a golf cart 1402, a station divider 1501, etc. as exemplarily illustrated in FIGS. 13A-15B. A station divider 1501 is a physical divider that separates one practice station from neighboring practice stations.

As exemplarily illustrated in FIG. 4, the fastener 105 comprises a lower case "h" shaped clamp 105. The "h" shaped clamp 105 comprises a protruding section 105*f* and two similar legs 105*a* and 105*h* substantially parallel to each other. A screw 105*c* engages a threaded hole (not shown) in one of the legs 105*h* of the "h" shaped clamp 105. The screw 105*c* comprises the engaging section 105*j* and a free end 105*b* that faces the other leg 105*a* of the "h" shaped clamp 105. A handle 105*d* rigidly attached to one end 105*k* of the screw 105*c* enables the user to rotate the screw 105*c*.

The pole holder 103 is pivotally attached to the protruding section 105*f* of the lower case "h" shaped clamp 105 using, for example, a threaded stud 105*i*, a nut 105*g*, and a handle 105*e*. The threaded stud 105*i* penetrates the protruding section 105*f* of the lower case "h" shaped clamp 105. One end 105*l* of the threaded stud 105*i* is rigidly attached to the handle 105*e*. The other end 105*m* of the threaded stud 105*i* engages the nut 105*g*. As illustrated in FIG. 4, the pole holder 103 is pivotable about the third axis 113, enabling movement of the rotatable reflecting surface 101 along a vertically oriented arc. The tightness between the pole holder 103 against the protruding section 105*f* of the "h" shaped clamp 105 can be adjusted by turning the handle 105*e*. The user can, for example, adjust the pivot angle of the pole holder 103 by first turning the handle 105*e* to loosen the threaded stud 105*i*, adjusting the pole holder 103 to a desired pivot angle about the third axis 113, and then locking the pole holder 103 in that pivot angle by turning the handle 105*e* again to tighten the threaded stud 105*i*.

Figure 5:
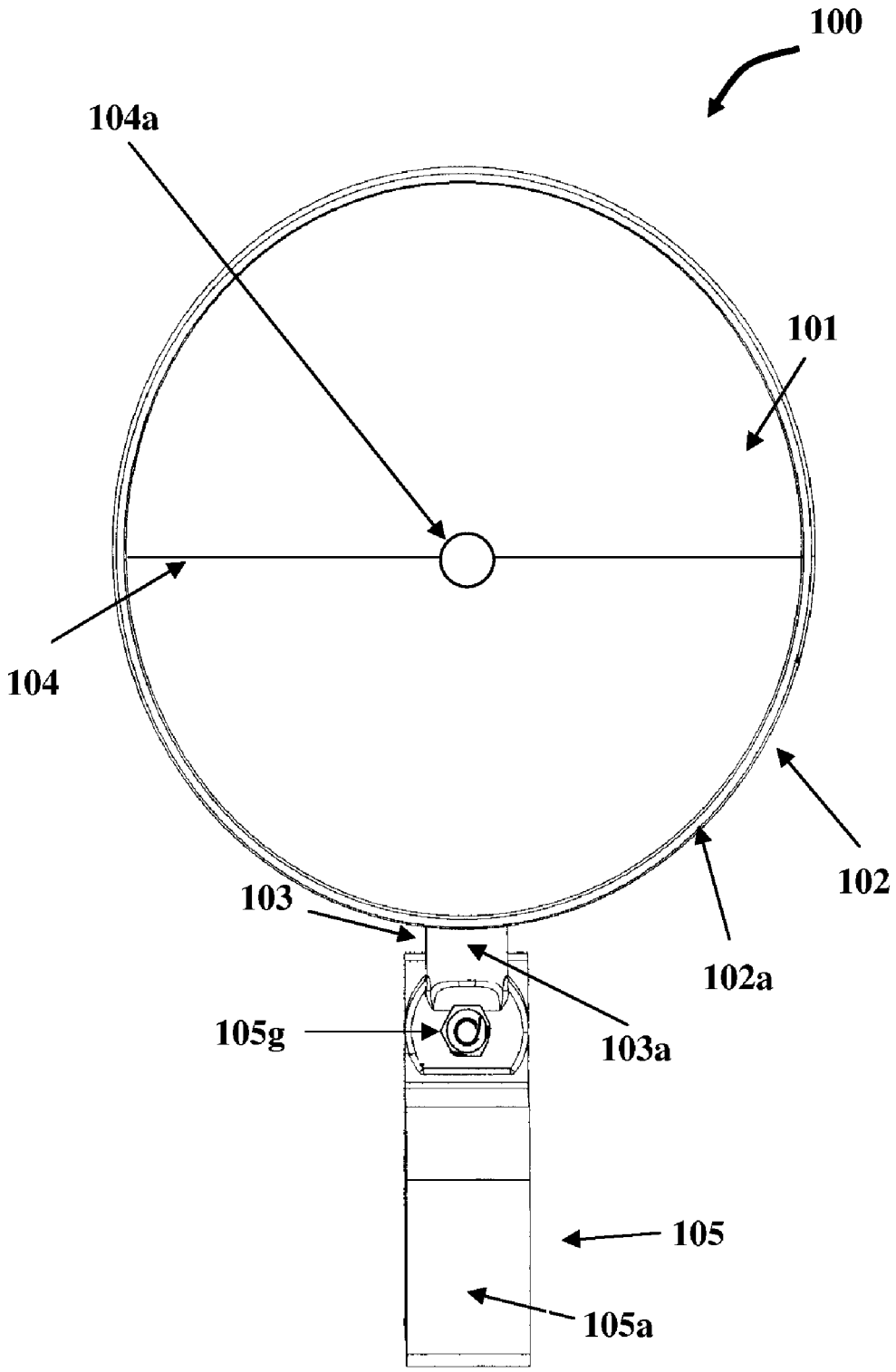
FIG. 5 exemplarily illustrates an orthogonal front view of the portable apparatus.

In another embodiment, the nut 105*g* forms an integral part of the pole holder 103, eliminating the need for a separate nut 105*g*. In another embodiment, the pole holder 103 comprises internal threads to engage the threaded stud 105*i*, eliminating the need for a separate nut 105*g*. An orthogonal front view of the portable apparatus 100 is exemplarily illustrated in FIG. 5. In FIG. 5, the telescopic pole 111 is in a fully retracted position inside the pole holder 103.

Figure 6:
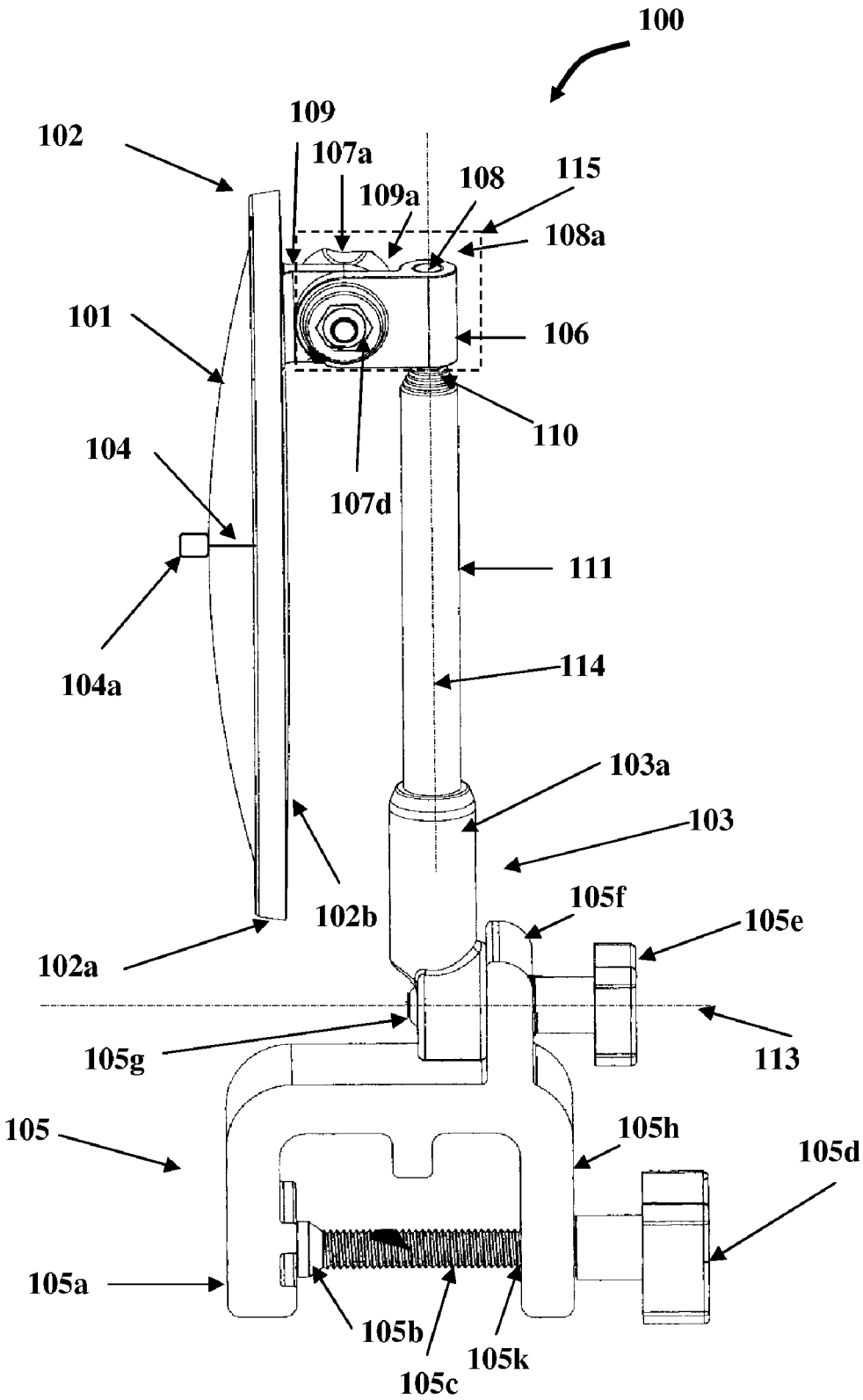
FIG. 6 exemplarily illustrates a right side perspective view of the portable apparatus.

FIG. 6 exemplarily illustrates a right side perspective view of a portable apparatus 100. Toward the bottom portion of the leg 105*h* of the "h" shaped clamp 105, the screw 105*c* engages a threaded hole (not shown) in the leg 105*h* of the "h" shaped clamp 105, below the protruding section 105*f*. The screw 105*c* comprises the engaging section 105*j* and a free end 105*b* that faces the other leg 105*a* of the "h" shaped clamp 105. The handle 105*d* is rigidly attached to one end 105*k* of the screw 105*c* that is opposite to the free end 105*b*. The distance between the free end 105*b* of the screw 105*c* and the corresponding leg 105*a* of the "h" shaped clamp 105 can be adjusted by turning the handle 105*d*. The screw 105*c* and the "h" shaped clamp 105 together are used to secure the portable apparatus 100 on sports equipment, for example, a golf bag 1301, a golf cart 1402, or the station dividers 1501 on the driving ranges, as exemplarily illustrated in FIGS. 13A-15B.

A user can, for example, turn the handle 105*d* to move the free end 105*b* of the screw 105*c* away from the corresponding leg 105*a* of the "h" shaped clamp 105, to create a gap in between the free end 105*b* of the screw 105*c* and the corresponding leg 105*a* of the "h" shaped clamp 105. The "h" shaped clamp 105, together with the rest of the attached portable apparatus 100, is then lowered and positioned over the sports equipment to bring a portion of the sports equipment exactly across the gap between the free end 105*b* of the screw 105*c* and the corresponding leg 105*a* of the "h" shaped clamp 105. The handle 105*d* is then tightened to lock the "h" shaped clamp 105 tightly to the sports equipment. The configuration of the legs 105*a* and 105*h*, the screw 105*c*, the free end 105*b* of the screw 105*c*, and the handle 105*d* is exemplarily illustrated in FIG. 4.

Figure 7:
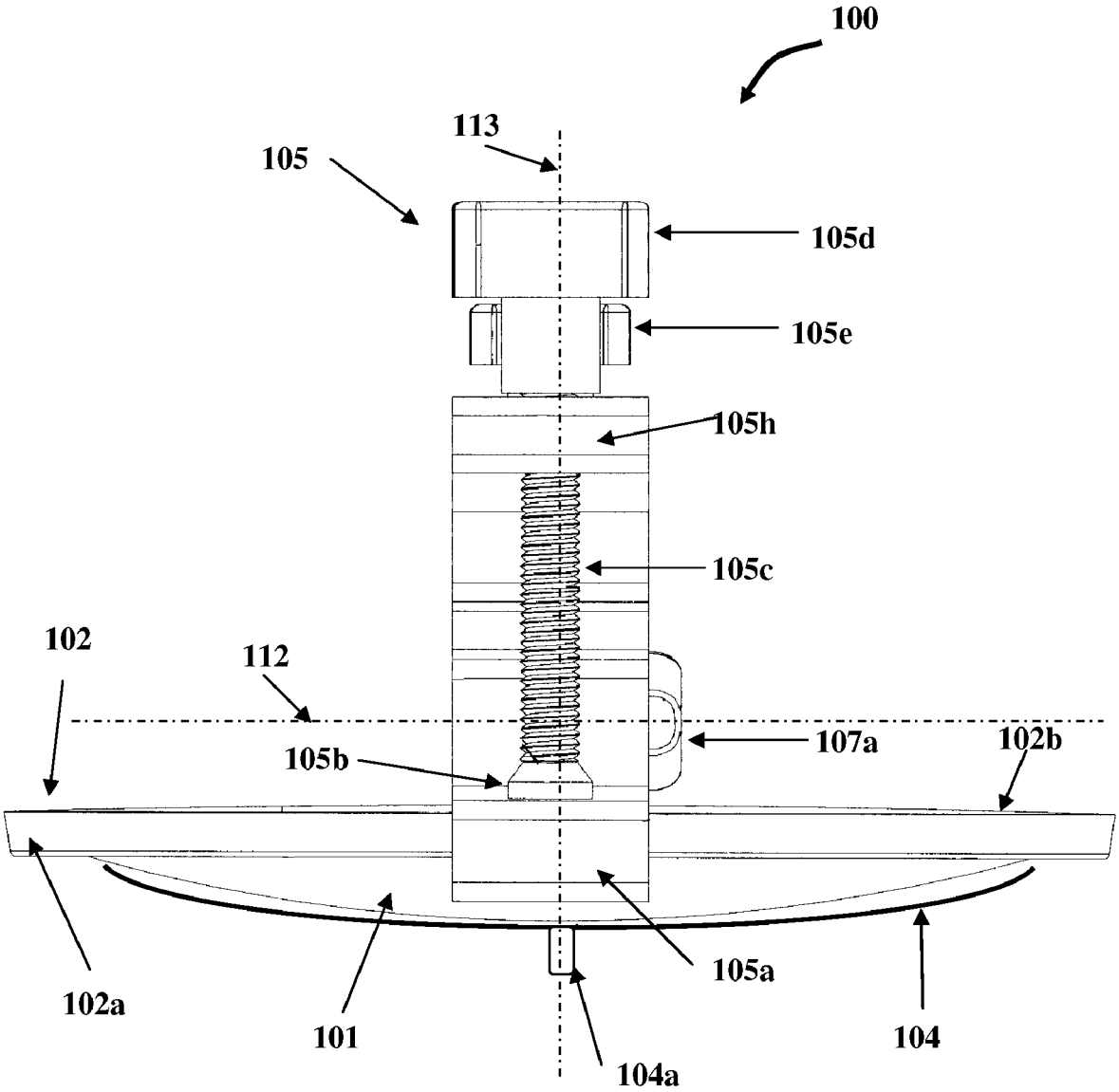
FIG. 7 exemplarily illustrates an orthogonal bottom view of the portable apparatus.
Figure 8:
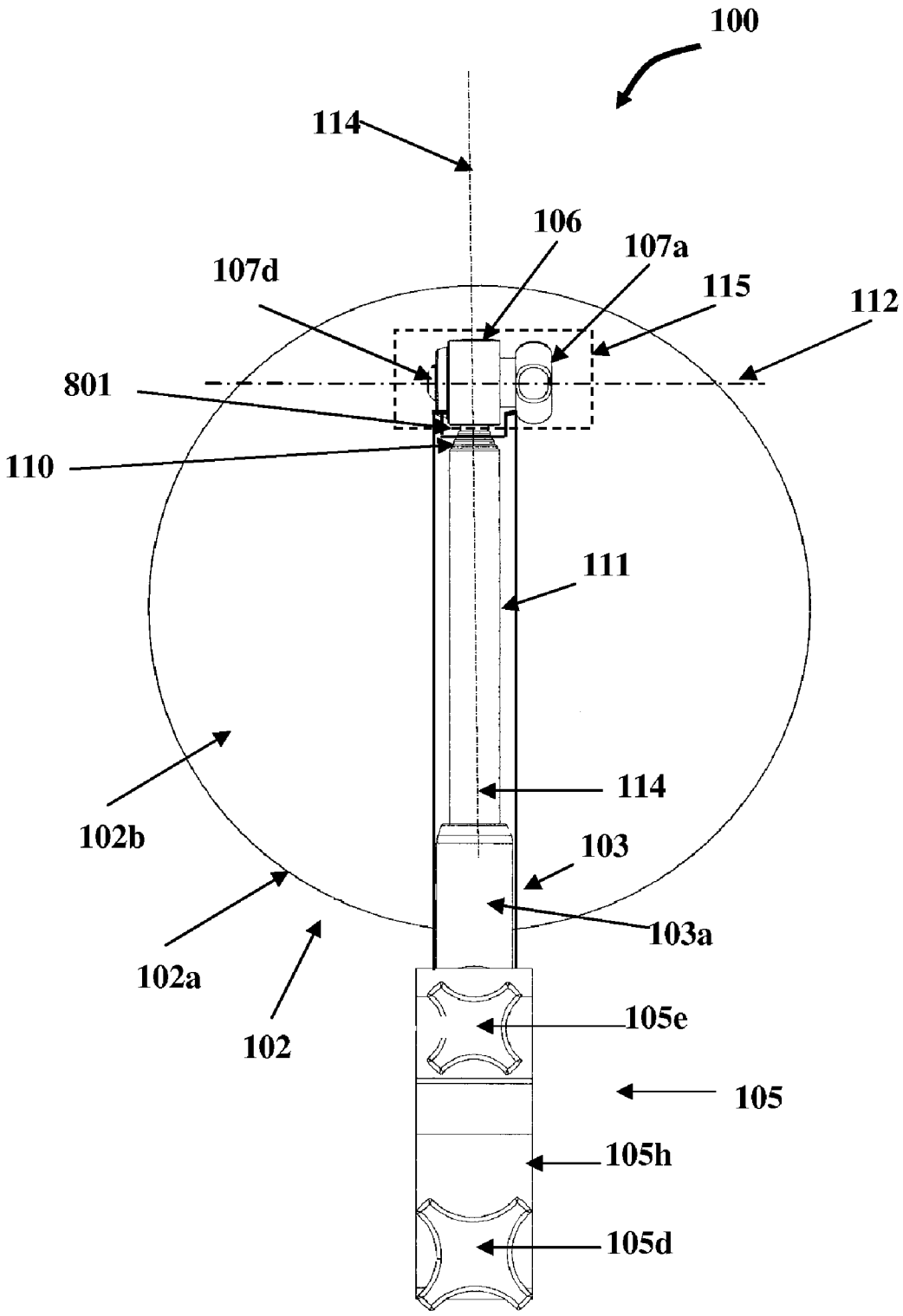
FIG. 8 exemplarily illustrates an orthogonal rear view of the portable apparatus.

FIG. 7 exemplarily illustrates an orthogonal bottom view of the portable apparatus 100. The screw 105*c* is fully engaged with the threaded hole (not shown) on the leg 105*h* of the "h" shaped clamp 105. An orthogonal rear view of the portable apparatus 100 is exemplarily illustrated in FIG. 8. Turning the handle 107*a* locks the rotatable reflecting surface 101 housed in the frame 102 in any desired position about the first axis 112. Turning the handle 105*d* locks or unlocks the "h" shaped clamp 105 to the sports equipment. Turning the handle 105*e* locks the pole holder 103 in a desired pivot angle about the third axis 113. The telescopic pole 111 is rotatable about the second axis 114. The vertical alignment of the rotatable reflecting surface 101, the frame 102, the rotating bracket 106, the telescopic pole 111 attached to the rotating bracket 106, the pole holder 103, and the "h" shaped clamp 105 is exemplarily illustrated in FIG. 8.

Figure 9:
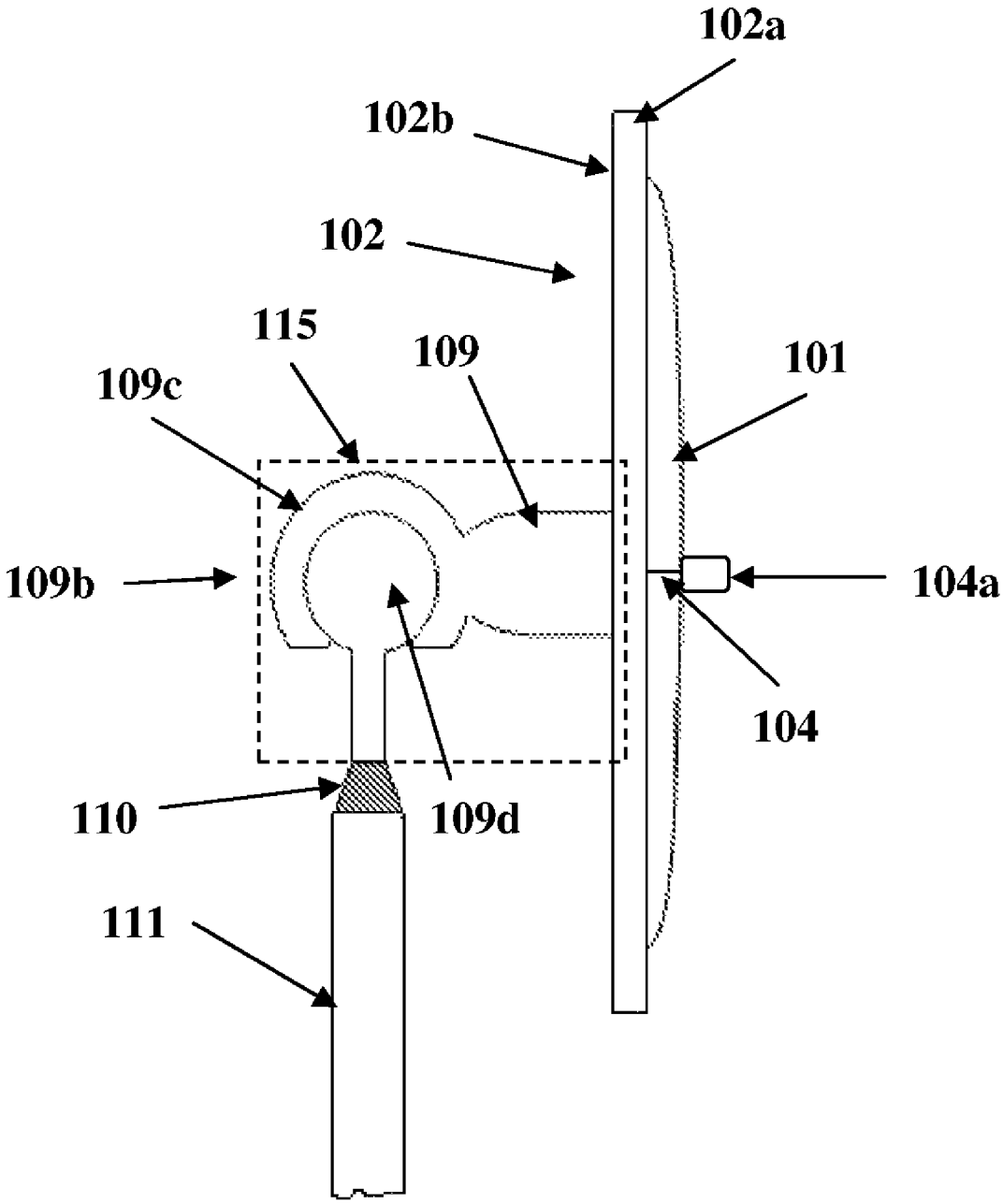
FIG. 9 exemplarily illustrates an orthogonal side view of the portable apparatus, showing an embodiment of an attachment assembly of the portable apparatus.

FIG. 9 exemplarily illustrates an orthogonal side view of the portable apparatus 100, showing another embodiment of the attachment assembly 115 of the portable apparatus 100. In this embodiment, the attachment assembly 115 comprises a ball joint 109*b* that connects the rear section 102*b* of the frame 102 to the telescopic pole 111. The ball joint 109*b* enables rotation of the rotatable reflecting surface 101 about the ball joint 109*b*. The ball joint 109*b* comprises a ball 109*d* housed in a housing socket 109*c*. As exemplarily illustrated in FIG. 9, the ball 109*d* is rigidly attached to the telescopic pole 111. The housing socket 109*c* of the ball joint 109*b* extends from the fixed bracket 109 rigidly attached to the rear section 102*b* of the frame 102. The ball joint 109*b* enables rotation of the rotatable reflecting surface 101 about the ball joint 109*b* in variable axes.

Figure 10A:
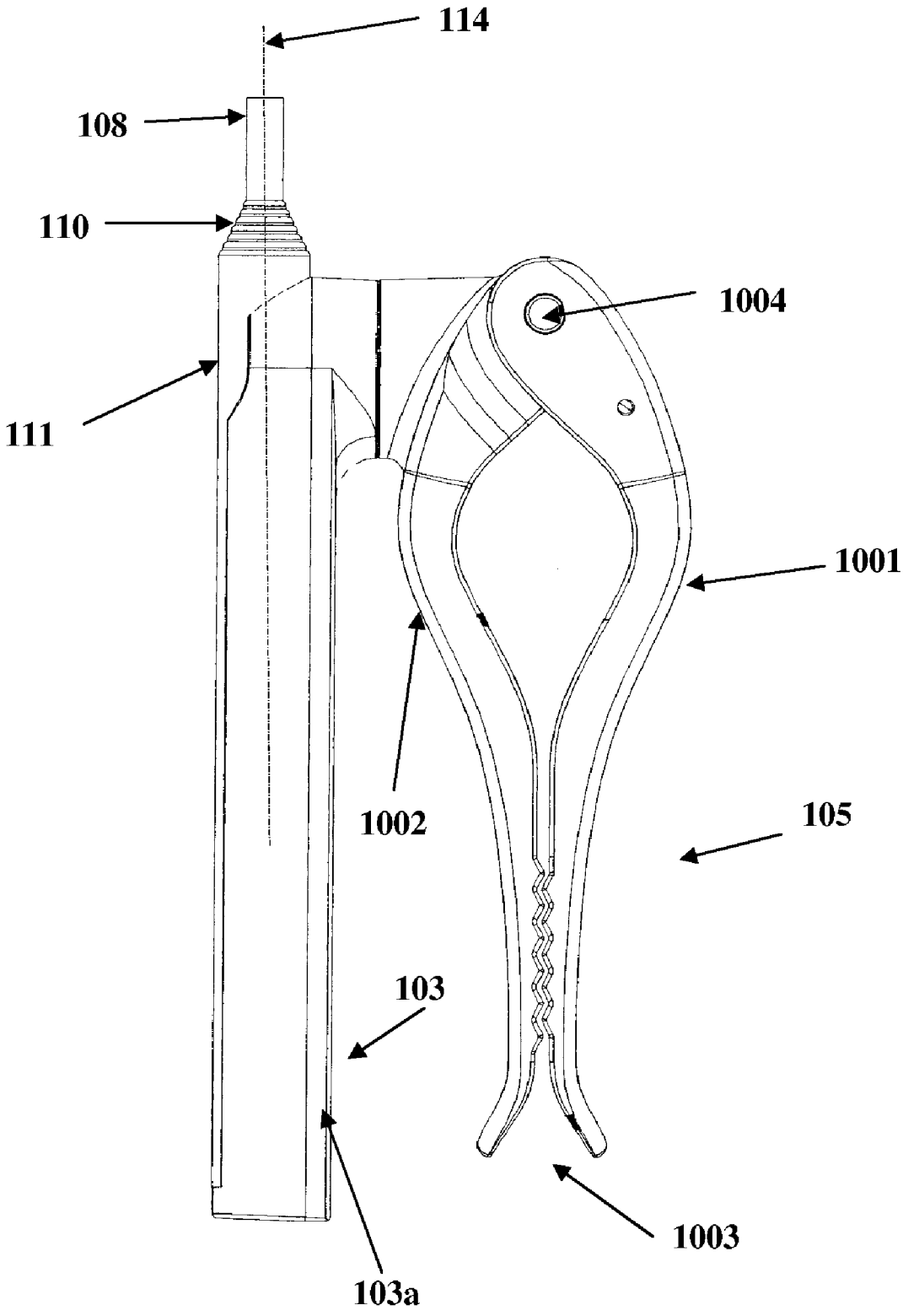
FIG. 10A exemplarily illustrates an orthogonal side view of the portable apparatus with an embodiment of a fastener of the portable apparatus.
Figure 10B:
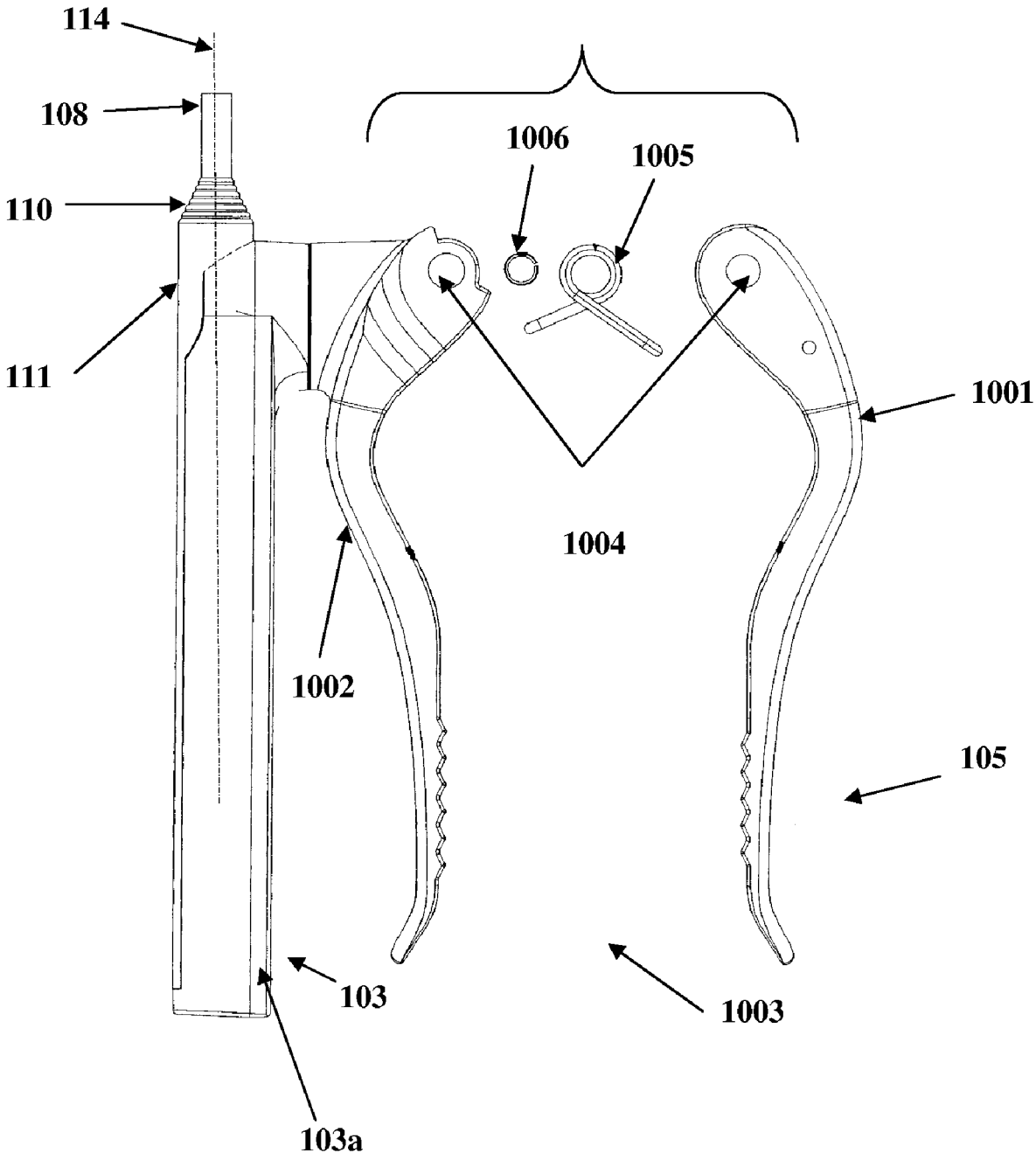
FIG. 10B exemplarily illustrates an orthogonal side view of the portable apparatus with an exploded view of the embodiment of the fastener.

FIGS. 10A-10B exemplarily illustrate orthogonal side views of the portable apparatus 100 with another embodiment of the fastener 105 of the portable apparatus 100. In this embodiment, the fastener 105 is in the shape of a caliper. The fastener 105 comprises a male component 1001 and a female component 1002. The male component 1001 and the female component 1002 are pivotally attached at a pivot point 1004 as illustrated in FIG. 10A, enabling the male component 1001 and the female component 1002 to rotate about the pivot point 1004 and facilitating the mouth 1003 of the fastener 105 to open up and enable clamping.

As illustrated in FIG. 10B, the male component 1001 and the female component 1002 are pivotally attached to each other using, for example, a torsion spring 1005 and a spring pin 1006. The rotational tension between the male component 1001 and the female component 1002 is applied by the torsion spring 1005, thereby enabling the fastener 105 to clamp the portable apparatus 100 to different sports equipment. Although the fastener 105 has been described herein with reference to an "h" shaped clamp or a caliper, the fastener 105 is not intended to be limited to the "h" shaped clamp or the caliper; rather, the scope of the fastener 105 extends to all functionally equivalent structures.

Figure 11:
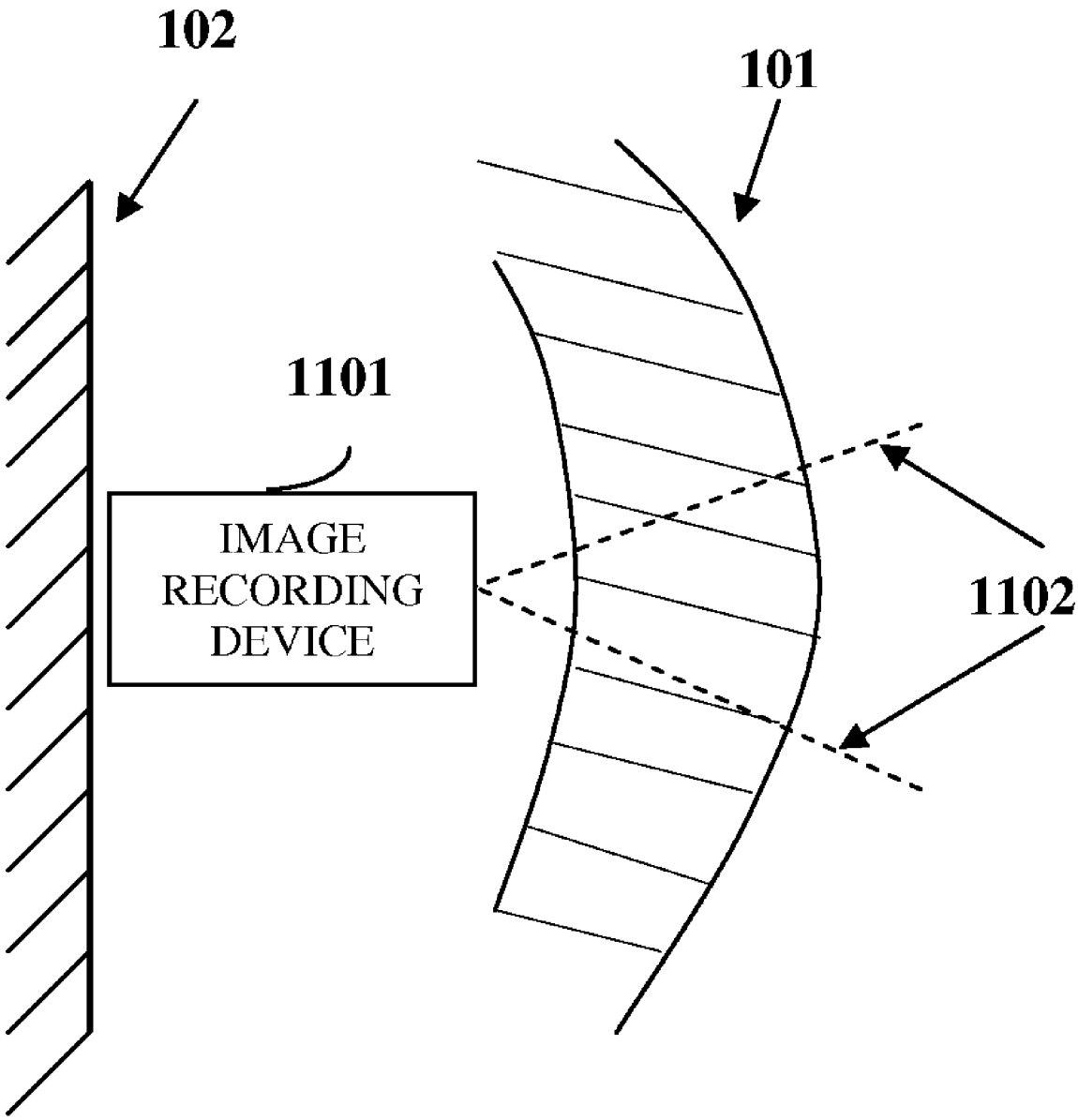
FIG. 11 exemplarily illustrates a block diagram of an image recording device positioned between the rotatable reflecting surface and the frame of the portable apparatus.

In an embodiment, an image recording device 1101, for example, a video recorder, is positioned between the rotatable reflecting surface 101, for example, a convex minor 101, and the frame 102 for recording a moving image of the sports swing of the user. FIG. 11 exemplarily illustrates a block diagram of the image recording device 1101 positioned between the rotatable reflecting surface 101 and the frame 102 of the portable apparatus 100. The image recording device 1101 records a moving image of the sports swing of the user obtained on the rotatable reflecting surface 101. FIG. 11 illustrates the partial cross-sections of the rotatable reflecting surface 101 and the frame 102. The convex minor 101 is a two-way mirror that allows light 1102 to pass through to the image recording device 1101 such that the image seen by the user on the convex minor 101 is the image that is recorded on the image recording device 1101. This embodiment is convenient for the user since the user does not require another person to help in recording the image properly. The user adjusts the convex mirror 101 to the desired position to record what the user sees on the convex mirror 101. The user views a reflection on the convex mirror 101, since the convex minor 101 reflects a percentage of the light 1102 and transmits the remainder of the light 1102 through to the image recording device 1101.

Figure 12:
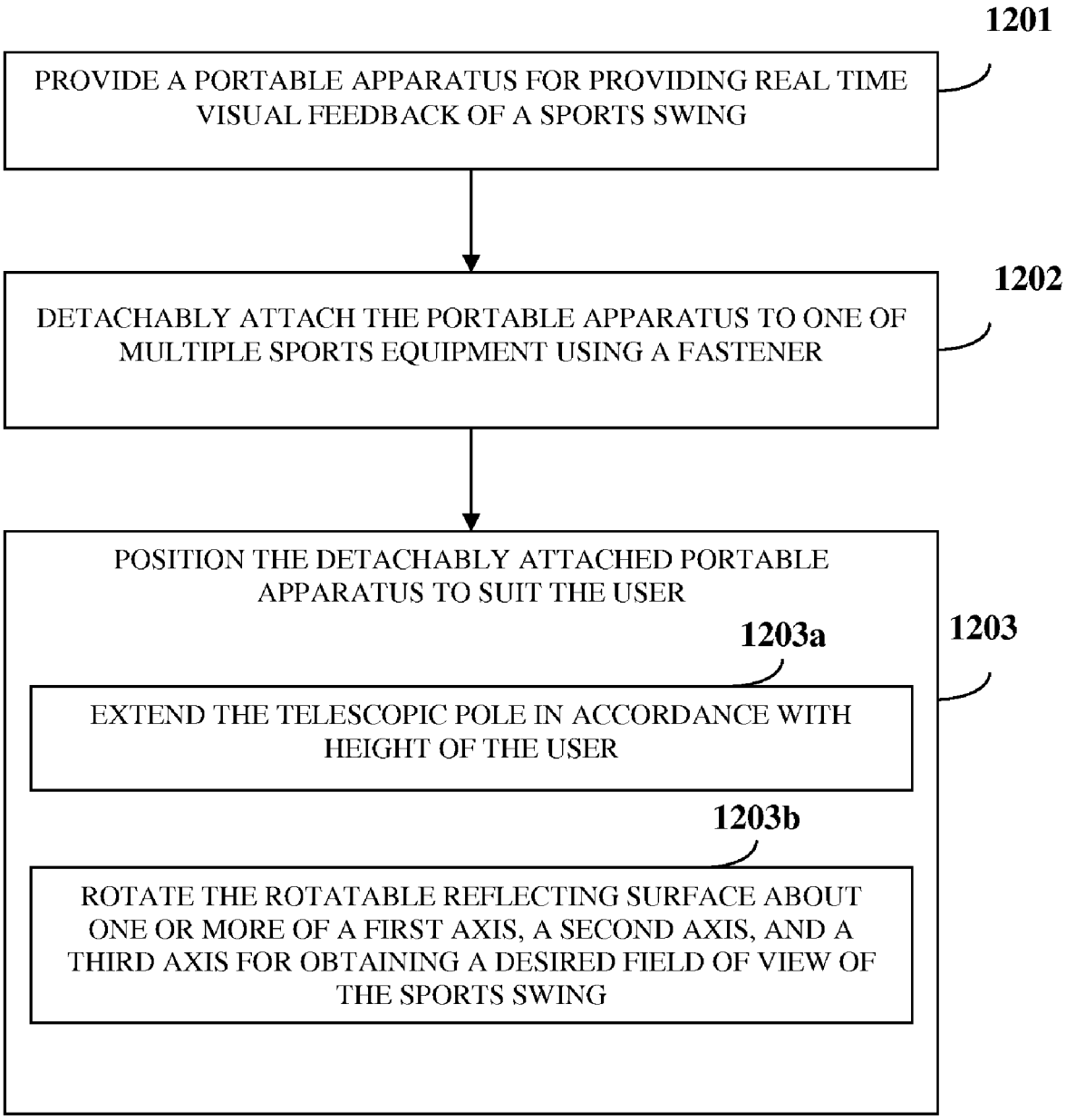
FIG. 12 illustrates a method of providing real time visual feedback of a sports swing to a user.
Figures 13A, 13B:
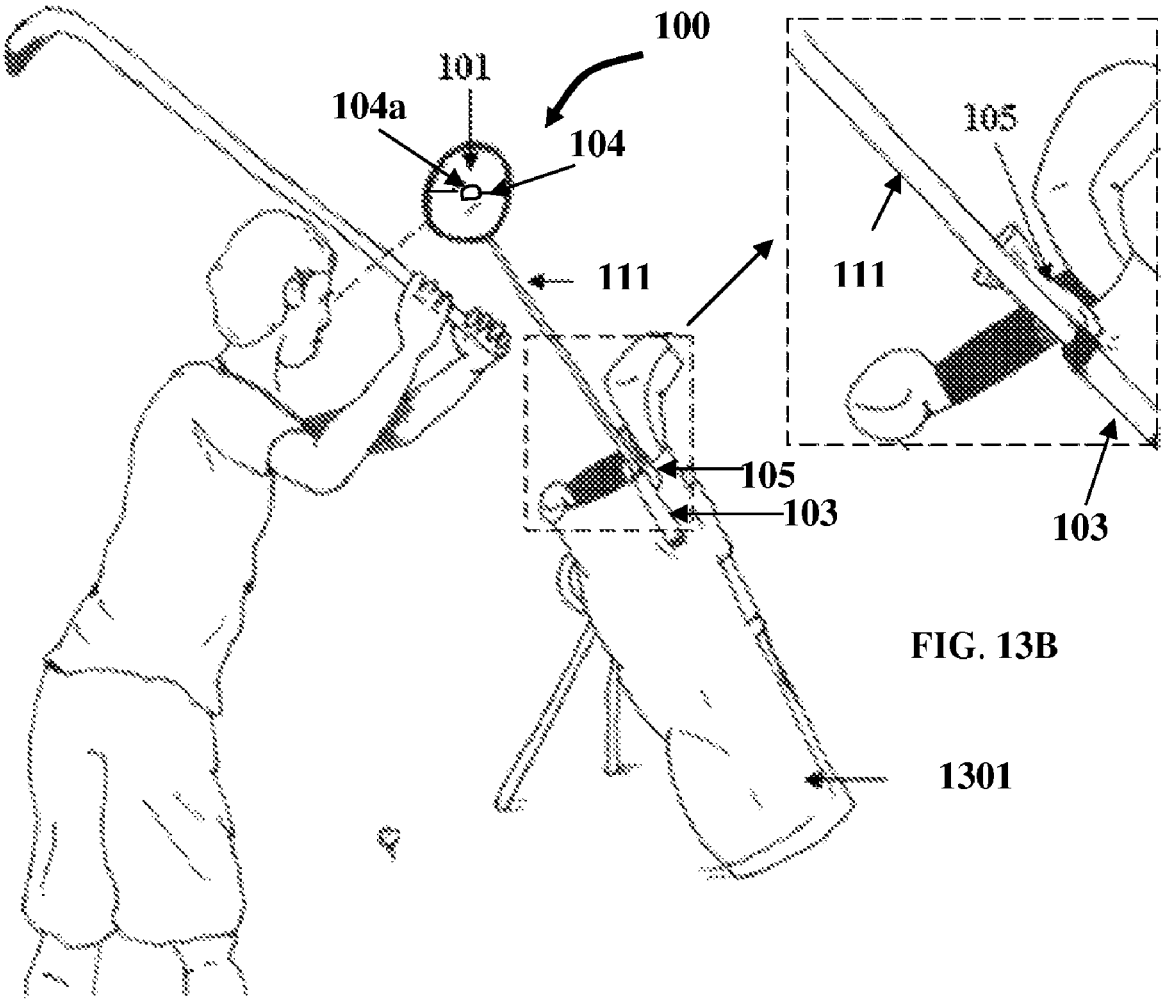
FIG. 13A exemplarily illustrates a perspective view of the portable apparatus attached to a golf bag using a fastener.
FIG. 13B illustrates an enlarged perspective view of the portable apparatus attached to the golf bag using the fastener.
Figures 14A, 14B:
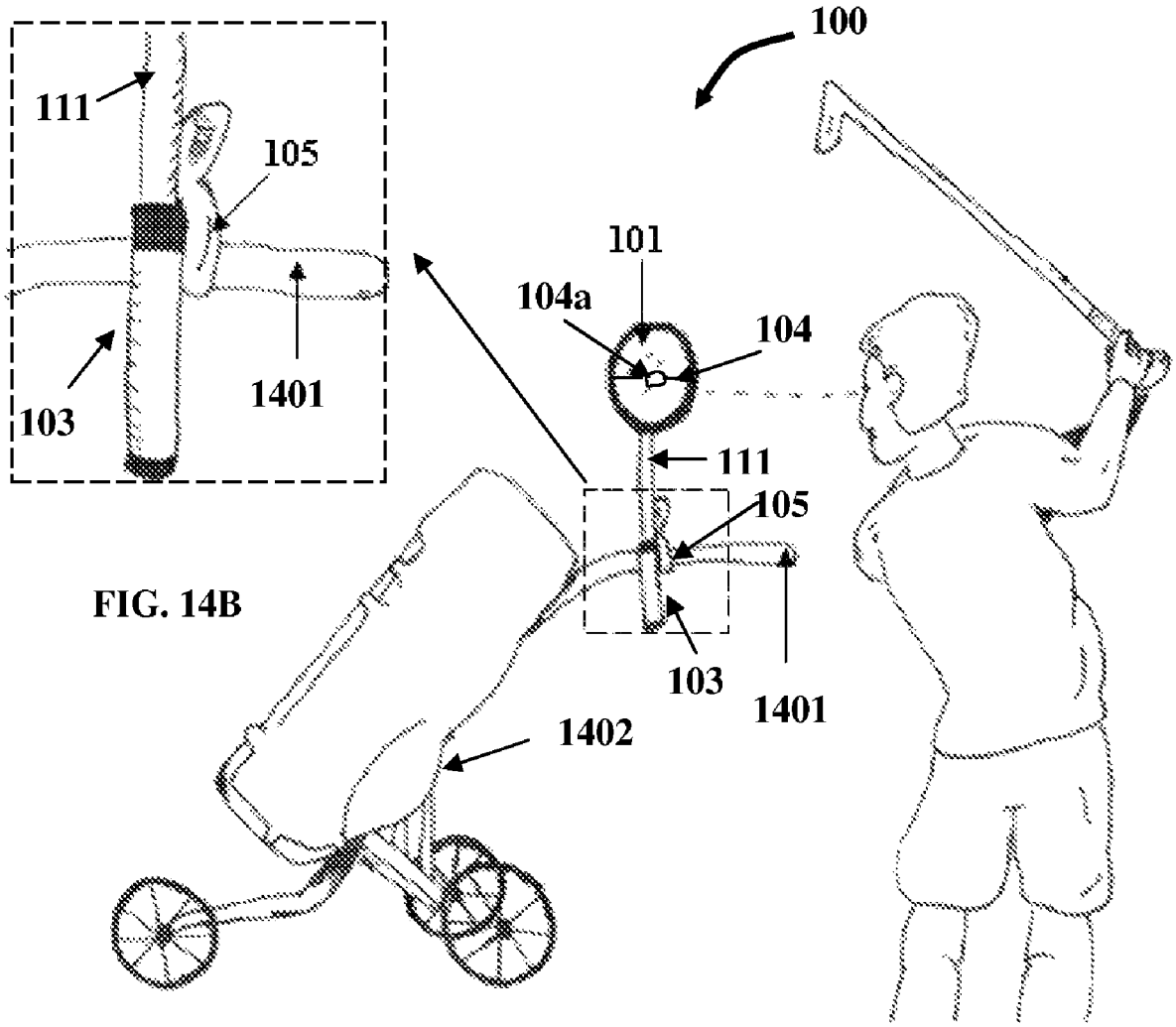
FIG. 14A exemplarily illustrates a perspective view of the portable apparatus attached to a handle of a golf cart using the fastener.
FIG. 14B illustrates an enlarged perspective view of the portable apparatus attached to the handle of the golf cart using the fastener.
Figures 15A, 15B:
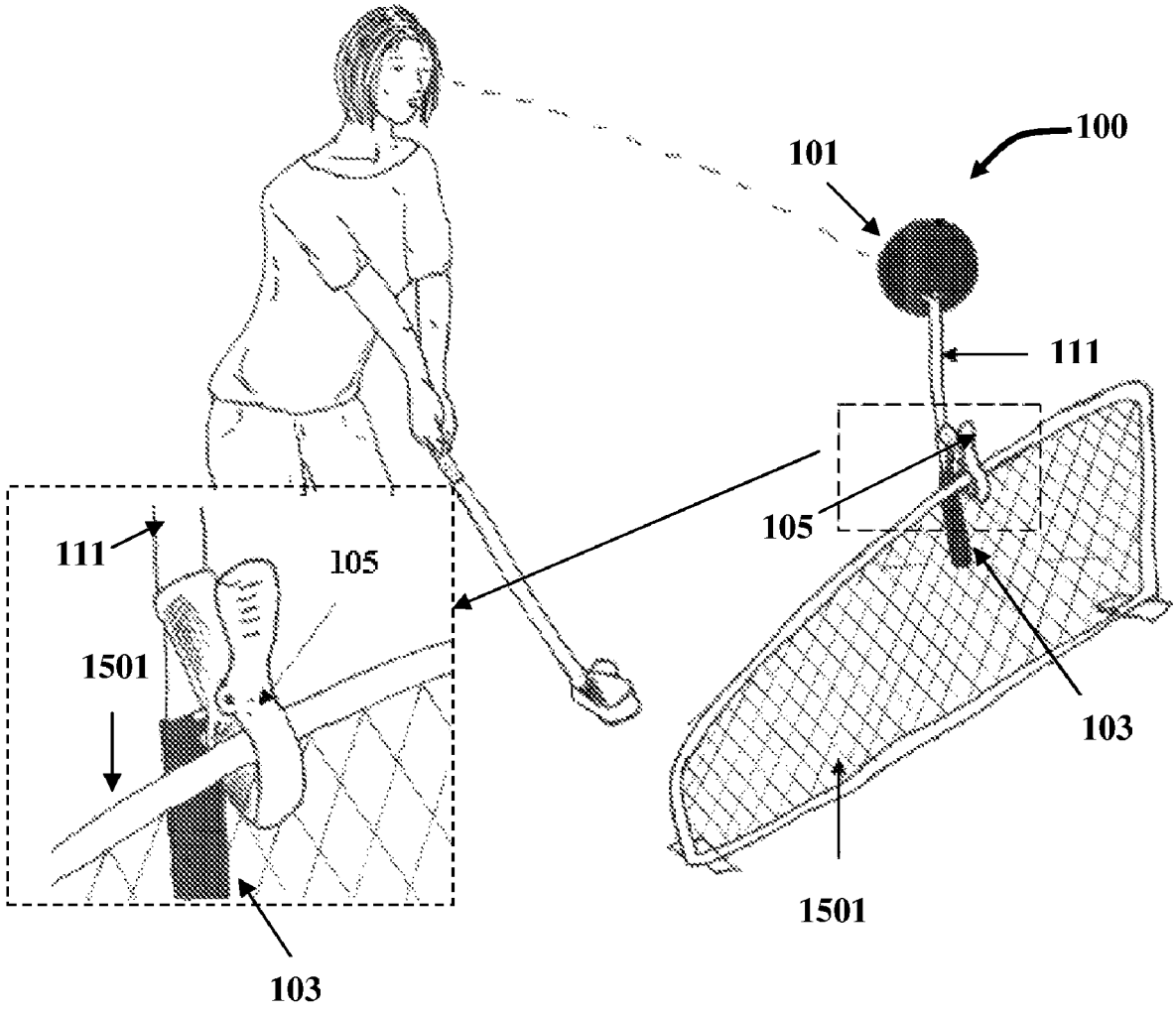
FIG. 15A exemplarily illustrates a perspective view of the portable apparatus attached to a range station divider using the fastener.
FIG. 15B illustrates an enlarged perspective view of the portable apparatus attached to the range station divider using the fastener.

FIG. 12 illustrates a method of providing real time visual feedback of a sports swing to a user. A portable apparatus 100 as illustrated and described in the detailed description of FIGS. 1-11 is provided 1201. The portable apparatus 100 is detachably attached 1202 to one of multiple sports equipment using the fastener 105. The detachably attached portable apparatus 100 is positioned 1203 on the sports equipment for obtaining the real time visual feedback of the sports swing. The telescopic pole 111 is extended 1203*a* in accordance with the height of the user. The rotatable reflecting surface 101 is rotated 1203*b* about one or more of the first axis 112, the second axis 114, and the third axis 113 for obtaining a desired field of view of the sports swing. The rotatable reflecting surface 101 is made a part of the sports equipment for obtaining the real time visual feedback of the sports swing. Attaching the rotatable reflecting surface 101 of the portable apparatus 100 to the sports equipment through the fastener 105 and positioning the attached rotatable reflecting surface 101 for obtaining a desired field of view provides the real time visual feedback of the sports swing to the user.

The integration of the portable apparatus 100 to sports equipment is exemplarily illustrated in FIGS. 13A-15B. Although the detailed description refers to attachment of the portable apparatus 100 disclosed herein to golf equipment 1301, 1402, and 1501 for providing real time visual feedback of a golf swing, the scope of the portable apparatus 100 and method disclosed herein is not limited to golf equipment 1301, 1402, and 1501 for use while playing golf, but may be incorporated in different sports equipment while playing different sports for obtaining real time visual feedback. The portable apparatus 100 may be detachably attached to a golf bag 1301 along the rim of the golf bag 1301 using the fastener 105 as exemplarily illustrated in FIG. 13A. An enlarged perspective view of the portable apparatus 100 attached to the golf bag 1301 using the fastener 105 is exemplarily illustrated in FIG. 13B. The portable apparatus 100 may also be detachably attached to a handle 1401 of a golf cart 1402 as exemplarily illustrated in FIG. 14A. An enlarged perspective view of the portable apparatus 100 attached to the handle 1401 of the golf cart 1402 using the fastener 105 is exemplarily illustrated in FIG. 14B. The portable apparatus 100 may also be attached to any other part of the golf cart 1402. The portable apparatus 100 may further be detachably attached to a range station divider 1501 as exemplarily illustrated in FIG. 15A. An enlarged perspective view of the portable apparatus 100 attached to the range station divider 1501 using the fastener 105 is exemplarily illustrated in FIG. 15B. The fastener 105 closes tightly over the golf bag 1301, the handle 1401 of the golf cart 1402, or the range station divider 1501, thus eliminating the need for the user to carry an extra piece of equipment.

Consider an example, where the user, herein referred to as a "golfer", uses the portable apparatus 100 to practice golf swings on level ground in front of the rotatable reflecting surface 101 with the golfer facing the rotatable reflecting surface 101. The golfer attaches the portable apparatus 100 to a golf bag 1301 using the fastener 105, for example, an "h" shaped clamp 105 as illustrated in FIG. 1. The golfer turns the handle 105*d* of the screw 105*c* to move the free end 105*b* of the screw 105*c* away from the corresponding leg 105*a* of the "h" shaped clamp 105, to create a gap in between the free end 105*b* of the screw 105*c* and the corresponding leg 105*a* of the "h" shaped clamp 105. The golfer holds the telescopic pole 111 in one hand and lowers the "h" shaped clamp 105, together with the rest of the portable apparatus 100, over the rim of the golf bag 1301 to bring a portion of the rim of the golf bag 1301 across the gap between the free end 105*b* of the screw 105*c* and the corresponding leg 105*a* of the "h" shaped clamp 105. The golfer then tightens the handle 105*d* using his/her free hand to lock the "h" shaped clamp 105 tightly to the rim of the golf bag 1301. The golfer releases the grasp on the telescopic pole 111, and checks for firmness of the attachment of the "h" shaped clamp 105 to the golf bag 1301.

After attaching the portable apparatus 100 to the golf bag 1301, the golfer maneuvers the rotatable reflecting surface 101 to a desired position, for example, approximately 10 feet away from the portable apparatus 100, such that the golfer obtains a desired field of view of the golf swing when the golfer assumes a golf stance. The golfer rotates the frame 102 housing the rotatable reflecting surface 101 about the first axis 112 using one hand such that the rotatable reflecting surface 101 housed in the frame 102 is substantially perpendicular to the ground level. Once the rotatable reflecting surface 101 is substantially perpendicular to the ground level, the golfer tightens the fixed bracket 109 of the attachment assembly 115 by turning the handle 107*a* using the free hand to lock the rotatable reflecting surface 101 in the desired position. In a similar manner, the golfer rotates the frame 102 about the second axis 114, such that the rotatable reflecting surface 101 housed in the frame 102 will face the golfer when the golfer assumes the golf stance approximately 10 feet away from the portable apparatus 100. The golfer also adjusts the pivot angle of the rotatable reflecting surface 101 to a desired pivot angle about the third axis 113.

The golfer may extend or retract the telescopic pole 111 to a sufficient height, such that the rotatable reflecting surface 101 provides a desired field of view of the golf swing when the golfer assumes the golf stance. The golfer slidably rotates the rotatable line element 104 over the rotatable reflecting surface 101 with his/her hands along the hollow track 301 to a desired sweep angle. For example, the golfer sets the desired sweep angle of the rotatable line element 104 to obtain a swing plane reference line on the rotatable reflecting surface 101 for practicing a precise backward swing lift for a drive stroke. The golfer then assumes the golf stance at various distances away from the portable apparatus 100.

The distance may vary based on the type of golf club the golfer is using. For example, when using a driver, the golfer may stand approximately 5 feet or more away from the portable apparatus 100. When using a sand wedge, the golfer may stand closer, which may be 3 feet or more away from portable apparatus 100 with the portable apparatus 100 in a direct field of vision of the golfer. The golfer facing the rotatable reflecting surface 101 views his/her reflection on the rotatable reflecting surface 101 with the desired field of view. The golfer may stand facing the portable apparatus 100, or may stand sideways or adjacent to the portable apparatus 100, depending on what the golfer wishes to check. For example, when golfer wishes to check his/her shoulder turn or hip turn while swinging the golf club, the golfer may stand facing the portable apparatus 100. If the golfer wishes to check his/her swing plane, or check if the golf club is pointing at the target during the back swing, the golfer may stand sideways to the portable apparatus 100. The golfer uses the rotatable line element 104 on the rotatable reflecting surface 101 to check or guide various aspects of his/her swing. For example, when standing right in front facing the portable apparatus 100, the golfer may slide the rotatable line element 104 in a position perpendicular to the ground level. The golfer can then use the rotatable line element 104 to identify the center point of his/her swing stance or the position of the golf ball, and then during the back swing, the golfer can check his/her shoulder turn to make sure the left shoulder or right shoulder is turned passed the rotatable line element 104 to ensure a full shoulder turn. Also, the golfer can check against the rotatable line element 104 to ensure his/her hip is still relatively positioned along the rotatable line element 104 and has not moved away from the rotatable line element 104. During the down swing, at the point of impact of the golf club with the golf ball, the golfer can also check to make sure his/her head position is behind the perpendicular line; thus ensuring the golfer's weight is behind the golf ball.

Another application of the rotatable line element 104 is as follows: When standing sideways to the portable apparatus 100, the rotatable line element 104 can be turned to a certain angle to simulate the swing plane that the golfer wishes to follow. Thus when the golfer practices his/her swing, the golfer can try to make sure the swing path is always aligned with the swing plane from the top of the back swing to the moment of impact position. By following the proper swing plane, the golfer can ensure the golf club is striking the golf ball properly, that is, striking the golf ball at the proper angle, with the proper stance, etc. It would be appreciated that the sequence of the steps in the foregoing example, such as, rotating the rotatable reflecting surface 101 about the three axes 112, 113, and 114, and varying the height of the rotatable reflecting surface 101 could be different and is not limited to the sequence explained in the foregoing example. It would also be appreciated that the golfer could carry out one or more of the foregoing steps to obtain the desired field of view of the sports swing.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. A portable apparatus for providing real-time visual feedback of a sports swing to a user comprising:

a rotatable reflecting surface of a predefined shape housed in a frame, said frame accommodating said rotatable reflecting surface, wherein said frame defines a rear section, and wherein said rotatable reflecting surface enables said user to view said sports swing;

an attachment assembly comprising a ball joint that connects said rear section of said frame accommodating said rotatable reflecting surface to said telescopic pole, wherein said ball joint enables rotation of said rotatable reflecting surface about said ball joint;

a telescopic pole rotatably attached to said attachment assembly for facilitating rotation of said rotatable reflecting surface housed in said frame about a second axis;

a fastener pivotally attached to said telescopic pole for facilitating rotation of said telescopic pole about a third axis, wherein said fastener enables attachment of said portable apparatus to a plurality of sports equipment; and a rotatable line element representing a swing plane line disposed over said rotatable reflecting surface housed in said frame, wherein said rotatable line element enables said user to sweep said rotatable line element over said rotatable reflecting surface housed in said frame to provide guidance to said user for simulating a swing plane;

whereby attaching said rotatable reflecting surface of said portable apparatus to said sports equipment through said fastener and positioning said attached rotatable reflecting surface for obtaining a desired field of view provides said real time visual feedback of said sports swing to said user.

2. The portable apparatus of claim 1, wherein said attachment assembly comprises a fixed bracket rigidly attached to said rear section of said frame and a rotating bracket pivotally attached to said fixed bracket for facilitating rotation of said rotatable reflecting surface about said first axis.

3. The portable apparatus of claim 1, further comprising a pole holder defining a hollow tubular body to accommodate said telescopic pole along said second axis, wherein said telescopic pole is rigidly attached to said pole holder.

4. The portable apparatus of claim 3, wherein said fastener enables pivoting of said pole holder to a desired pivot angle about said third axis for facilitating final positioning of said rotatable reflecting surface housed in said frame.

5. The portable apparatus of claim 3, wherein said attachment assembly comprises a rotating bracket attached to said pole holder.

6. The portable apparatus of claim 5, wherein said pole holder comprises a cavity for fitting said rotating bracket of said attachment assembly when said telescopic pole is completely retracted into said pole holder.

7. A portable apparatus for providing real-time visual feedback of a sports swing to a user comprising:

a rotatable reflecting surface of a predefined shape housed in a frame, said frame accommodating said rotatable reflecting surface, wherein said frame defines a rear section, and wherein said rotatable reflecting surface enables said user to view said sports swing;

an attachment assembly connected to said rear section of said frame for facilitating rotation of said rotatable reflecting surface housed in said frame about a first axis;

a telescopic pole rotatably attached to said attachment assembly for facilitating rotation of said rotatable reflecting surface housed in said frame about a second axis;

a fastener pivotally attached to said telescopic pole for facilitating rotation of said telescopic pole about a third axis, wherein said fastener enables attachment of said portable apparatus to a plurality of sports equipment; and a rotatable line element representing a swing plane line disposed over said rotatable reflecting surface housed in said frame, wherein said rotatable line element enables said user to sweep said rotatable line element over said rotatable reflecting surface housed in said frame to provide guidance to said user for simulating a swing plane;

whereby attaching said rotatable reflecting surface of said portable apparatus to said sports equipment through said fastener and positioning said attached rotatable reflecting surface for obtaining a desired field of view provides said real time visual feedback of said sports swing to said user.

8. The portable apparatus of claim 7, wherein said rotatable line element is hinged to center of said rotatable reflecting surface housed in said frame, wherein said rotatable line element conforms to contour of said rotatable reflecting surface housed in said frame, wherein said rotatable line element enables said user to rotate said rotatable line element over said rotatable reflecting surface through said hinged center to provide guidance to said user to simulate a proper swing plane.

9. The portable apparatus of claim 7, wherein opposing ends of said rotatable line element are slidably attached to a hollow track disposed along periphery of said frame housing said rotatable reflecting surface, wherein said rotatable line element enables said user to rotate said rotatable line element over said rotatable reflecting surface along said hollow track to provide guidance to said user to simulate a proper swing plane.

10. The portable apparatus of claim 1, wherein said telescopic pole comprises a predetermined number of coaxial concentric sections for allowing extension and retraction of said telescopic pole in accordance with height of said user.

11. The portable apparatus of claim 1, wherein said rotatable reflecting surface is a convex mirror of said predefined shape and housed in said frame.

12. The portable apparatus of claim 7, further comprising an image recording device positioned between said rotatable reflecting surface and said frame housing said rotatable reflecting surface for recording a moving image of said sports swing of said user obtained on said rotatable reflecting surface.

13. A method for providing real time visual feedback of a sports swing to a user, comprising:

providing a portable apparatus, comprising:

a rotatable reflecting surface of a predefined shape housed in a frame, said frame accommodating said rotatable reflecting surface, wherein said frame defines a rear section; and wherein said rotatable reflecting surface enables said user to view said sports swing;

an attachment assembly connected to said rear section of said frame for facilitating rotation of said rotatable reflecting surface housed in said frame about a first axis;

a telescopic pole rotatably attached to said attachment assembly for facilitating rotation of said rotatable reflecting surface housed in said frame about a second axis; and a fastener pivotally attached to said telescopic pole for facilitating rotation of said telescopic pole about a third axis;

detachably attaching said portable apparatus to one of a plurality of sports equipment using said fastener;

positioning said detachably attached portable apparatus on said sports equipment for obtaining said real time visual feedback of said sports swing of said user, comprising one or more of:

extending said telescopic pole in accordance with height of said user; and rotating said rotatable reflecting surface about one or more of said first axis, said second axis, and said third axis for obtaining a desired field of view of said sports swing.

14. The method of claim 13, further comprising providing a rotatable line element representing a swing plane line disposed over said rotatable reflecting surface housed in said frame, wherein said rotatable line element is rotated by said user to sweep said rotatable line element over said rotatable reflecting surface housed in said frame for obtaining guidance for simulating a swing plane.

15. The method of claim 13, further comprising providing a pole holder defining a hollow tubular body to accommodate said telescopic pole along said second axis, wherein said telescopic pole is rigidly attached to said pole holder.

16. The method of claim 15, further comprising pivoting said pole holder to a desired pivot angle about said third axis for facilitating final positioning of said rotatable reflecting surface housed in said frame.

17. The method of claim 13, wherein said fastener enables integration of said portable apparatus to said sports equipment.

18. The method of claim 13, further comprising positioning said rotatable reflecting surface housed in said frame of said detachably attached portable apparatus at a distance from said user for providing a desired field of view to said user.

19. The method of claim 13, further comprising recording a moving image of said sports swing of said user obtained on said rotatable reflecting surface using an image recording device positioned between said rotatable reflecting surface and said frame housing said rotatable reflecting surface.

20. The method of claim 13, wherein said rotatable reflecting surface enables said user to view one or more of his/her body and his/her sports equipment, wherein a rotatable line element is disposed over said rotatable reflecting surface, wherein said rotatable line element is rotated by said user to sweep said rotatable line element over said rotatable reflecting surface housed in said frame for aligning one or more of said body part and said sports equipment with said rotatable line element.

* * * * *